US011633027B2

(12) United States Patent
Brouard et al.

(10) Patent No.: US 11,633,027 B2
(45) Date of Patent: Apr. 25, 2023

(54) WHEELED CARRIER WITH TELESCOPING CENTER HANDLE

(71) Applicant: Veto Pro Pac, LLC, Norwalk, CT (US)

(72) Inventors: Roger Brouard, Norwalk, CT (US); Lee Griswold, Bethel, CT (US)

(73) Assignee: VETO PRO PAC, LLC, Norwalk, CT (US)

( * ) Notice: Subject to any disclaimer, the term of this patent is extended or adjusted under 35 U.S.C. 154(b) by 491 days.

(21) Appl. No.: 16/778,535

(22) Filed: Jan. 31, 2020

(65) Prior Publication Data

US 2021/0235831 A1 Aug. 5, 2021

(51) Int. Cl.

| | |
|---|---|
| ***A45C 13/26*** | (2006.01) |
| ***A45F 3/04*** | (2006.01) |
| ***A45C 5/14*** | (2006.01) |

(52) U.S. Cl.

CPC ..... *A45C 13/262* (2013.01); *A45C 5/14* (2013.01); *A45F 3/04* (2013.01); *A45F 2200/0575* (2013.01)

(58) Field of Classification Search

CPC ..... A45C 13/262; A45C 2013/267
USPC ..... 190/109, 110, 111
See application file for complete search history.

(56) References Cited

U.S. PATENT DOCUMENTS

| | | | | |
|---|---|---|---|---|
| 2,465,847 | A | 3/1949 | Coffey | |
| 4,854,432 | A | 8/1989 | Carpenter et al. | |
| 5,762,168 | A | 6/1998 | Miyoshi | |
| 5,806,142 | A * | 9/1998 | Wang | A45C 13/262 190/115 |
| 6,056,301 | A | 5/2000 | Berliner et al. | |
| 6,126,003 | A * | 10/2000 | Brouard | B25H 3/00 206/372 |
| 6,149,168 | A | 11/2000 | Pauser | |
| 6,330,944 | B1 | 12/2001 | DeMichele | |
| 6,745,877 | B1 | 6/2004 | Tsai | |
| 6,915,902 | B2 | 7/2005 | Brouard | |
| D613,507 | S | 4/2010 | Brouard | |
| 7,828,457 | B2 | 11/2010 | Davidoff et al. | |
| D687,040 | S * | 7/2013 | Meadows | D14/447 |
| 8,919,628 | B2 | 12/2014 | Jamlang | |
| D739,654 | S | 9/2015 | Brouard | |

(Continued)

FOREIGN PATENT DOCUMENTS

| | | | |
|---|---|---|---|
| EP | 2441341 | A1 | 4/2012 |
| WO | 2006104299 | A1 | 10/2006 |

(Continued)

OTHER PUBLICATIONS

International Search Report and Written Opinion for App. No. PCT/US2021/015766, dated Sep. 1, 2021, 13 pages.

*Primary Examiner* — Jennifer Robertson
*Assistant Examiner* — Justin Caudill
(74) *Attorney, Agent, or Firm* — Dilworth IP, LLC

(57) ABSTRACT

A wheeled carrier according to aspects of the disclosure includes a concave base coupled to a durable fabric body. A pair of wheels is connected to the base and an ergonomic telescoping handle, spaced from a central axis of the wheels, is connected to the base providing a user with a carrier having even weight distribution and storage on both sides of the telescoping handle. The fabric body and internal pocket sleeves provide a plurality of organizational structures inside the wheeled carrier for tools, spare parts, and other equipment.

24 Claims, 39 Drawing Sheets

(56) References Cited

U.S. PATENT DOCUMENTS

| | | | | |
|---|---|---|---|---|
| 9,210,976 | B2 | 12/2015 | Maeda | |
| 9,345,301 | B2 | 5/2016 | Brouard et al. | |
| 9,498,055 | B2 * | 11/2016 | Distefano | A47B 13/088 |
| 9,539,722 | B2 | 1/2017 | Martinez et al. | |
| 9,616,562 | B2 | 4/2017 | Hoppe et al. | |
| 10,034,537 | B2 * | 7/2018 | Long, Jr. | A47B 3/10 |
| 10,086,508 | B2 | 10/2018 | Hoppe et al. | |
| 10,179,672 | B2 | 1/2019 | Kuhls | |
| D846,282 | S | 4/2019 | Brouard | |
| 10,350,746 | B2 | 7/2019 | Martinez et al. | |
| 10,376,029 | B2 | 8/2019 | Yu | |
| 10,405,624 | B2 | 9/2019 | Brouard | |
| 2003/0209396 | A1 | 11/2003 | Bernbaun et al. | |
| 2004/0031655 | A1 | 2/2004 | Milionta et al. | |
| 2006/0042896 | A1 * | 3/2006 | Godshaw | A45C 13/02 206/576 |
| 2007/0137960 | A1 * | 6/2007 | Redzisz | A45C 13/02 190/111 |
| 2007/0164064 | A1 | 7/2007 | Nathan | |
| 2008/0230416 | A1 * | 9/2008 | Brouard | B25H 3/02 224/191 |
| 2011/0011761 | A1 * | 1/2011 | Enmon | A45C 13/02 206/320 |
| 2014/0239024 | A1 | 8/2014 | Brouard | |
| 2016/0045022 | A1 * | 2/2016 | Shannon | A47B 13/16 108/166 |
| 2018/0116361 | A1 | 5/2018 | Anjum | |
| 2018/0235339 | A1 * | 8/2018 | Diamond | A45C 13/28 |
| 2019/0030705 | A1 | 1/2019 | Hoppe et al. | |

FOREIGN PATENT DOCUMENTS

| | | | |
|---|---|---|---|
| WO | 2015132520 | A1 | 9/2015 |
| WO | 20180041230 | A1 | 3/2018 |

* cited by examiner

WHEELED CARRIER WITH TELESCOPING CENTER HANDLE

BACKGROUND

The present disclosure relates to devices for organizing and transporting tools and other work implements, more specifically to a tool carrying arrangement having wheels and a telescoping handle.

Many boxes and bags have been used to organize and carry tools and other work implements. Rigid boxes for organizing and carrying tools are well-known. Buckets and soft bags are also commonly used for storing, transporting, and accessing tools and other work implements. When using traditional boxes, buckets and bags, it can be difficult to keep tools neatly arranged for quick access. Tools can be damaged by contact with each other during transport. Further, rigid buckets and tool boxes can be difficult to carry.

Modern infrastructure includes a huge number of widely dispersed subsystems and components that must be installed, maintained or repaired by service personnel. Such systems and components are found in every possible environment, from communications equipment on rooftops and towers to energy infrastructure in below ground tunnels and chambers. Manufacturing, office and residential structures also include widely dispersed equipment. Installation and service personnel must bring tools, diagnostic equipment and parts to the equipment, wherever it is located.

With these varying conditions, there is a need for versatile carriers for tool storage and transport that protect tools, keep them organized, allow easy access to the tools and provide the option of a wheeled or rolling mode while transporting the tools.

SUMMARY

In accordance with one aspect of the present disclosure, a wheeled carrier is disclosed. The wheeled carrier includes a base, a body, a pair of wheels, a support, and a telescoping handle. The base has a bottom surface, opposing first and second ends and opposing first and second lateral sides between the first and second ends. The body extends upward from the base. The body defines an interior. The pair of wheels is connected to the base. The pair of wheels are configured to rotate about a central axis. The central axis is proximate the second end. The support extends from the first and second lateral sides of the base to an apex. The apex of the support defines an opening. The telescoping handle projects from a center of the bottom surface of the base. The telescoping handle projects through the opening defined by the apex. The telescoping handle is configured to ergonomically aid a user in moving the wheeled carrier and divide the interior of the wheeled carrier.

In accordance with another aspect of the present disclosure, a wheeled carrier is disclosed. The wheeled carrier includes a base, a pair of wheels, and a telescoping handle. The base has a bottom surface, opposing first and second ends and opposing first and second lateral sides between the first and second ends. The pair of wheels is connected to the base. The pair of wheels are configured to rotate about a central axis. The telescoping handle extends from the bottom surface of the base. The telescoping handle extends along a plane substantially perpendicular to the base. The plane is between the first end of the base and the central axis. The central axis is spaced from the first end of the base and proximate the second end of the base. The central axis is between the second end of the base and the plane.

In accordance with another aspect of the present disclosure, a wheeled carrier is disclosed. The wheeled carrier includes a base, a body, a pair of wheels, and a telescoping handle. The base has a bottom surface, opposing first and second ends and opposing first and second lateral sides between the first and second ends. The wheeled carrier has an overall depth dimension between the first and second ends. The body extends upward from the base. The body defines an interior. The pair of wheels is connected to the base. The pair of wheels are configured to rotate about a central axis. The telescoping handle extends from the bottom surface of the base. The telescoping handle extends along a plane substantially perpendicular to the base. The plane is between two compartments of the interior. Each one of the two compartments has a depth dimension of at least one third of the overall depth dimension.

BRIEF DESCRIPTION OF THE DRAWINGS

The foregoing aspects and other features of the invention are explained in the following description, taken in connection with the accompanying drawings, wherein:

FIGS. 16-24 are various views of the pocket sleeve panels of the wheeled carrier shown in FIG. 1, in which FIG. 16 is an exploded view of the wheeled carrier and pocket sleeve panels, FIG. 17 is a right front perspective view of the wheeled carrier and pocket sleeve panels, FIG. 18 is a right rear perspective view of the wheeled carrier and pocket sleeve panels, FIG. 19 is a rear view of a first pocket sleeve panel, FIG. 20 is a rear view of a second pocket sleeve panel, FIG. 21 is an exploded view of the first pocket sleeve panel, FIG. 22 is a front view of the first pocket sleeve panel, FIG. 23 is an exploded view of the second pocket sleeve panel, and FIG. 24 is a front view of the second pocket sleeve panel;

FIGS. 36-41 illustrate varies views of rub rails used with an exemplary embodiment of the wheeled carrier shown in FIG. 31, in which FIG. 36 is a right side view of the rub rails and the wheeled carrier with a zipper pocket open, FIG. 37 is a right side view of the rub rails and the wheeled carrier with the zipper pocket closed, FIG. 38 is a rear view of the rub rails and the wheeled carrier, FIG. 39 is a left rear perspective view of the rub rails and the wheeled carrier, FIG. 40 is an inside perspective view of a rub rail, and FIG. 41 is an outside perspective view of the rub rail; and FIGS. 42-47 illustrate various views of an exemplary accessory used with the wheeled carrier shown FIGS. 1, 31, in which FIG. 42 is a right side view of the accessory and the wheeled carrier in a rolling configuration, FIG. 43 is a right side view of the accessory and the wheeled carrier in an upright configuration, FIG. 44 is a perspective view of the accessory in a folded configuration, FIG. 45 is a perspective view of the accessory in an extended configuration, FIG. 46 is a bottom perspective view of the accessory, and FIG. 47 illustrates steps for the attachment and use of the accessory.

DETAILED DESCRIPTION

Figure 1:
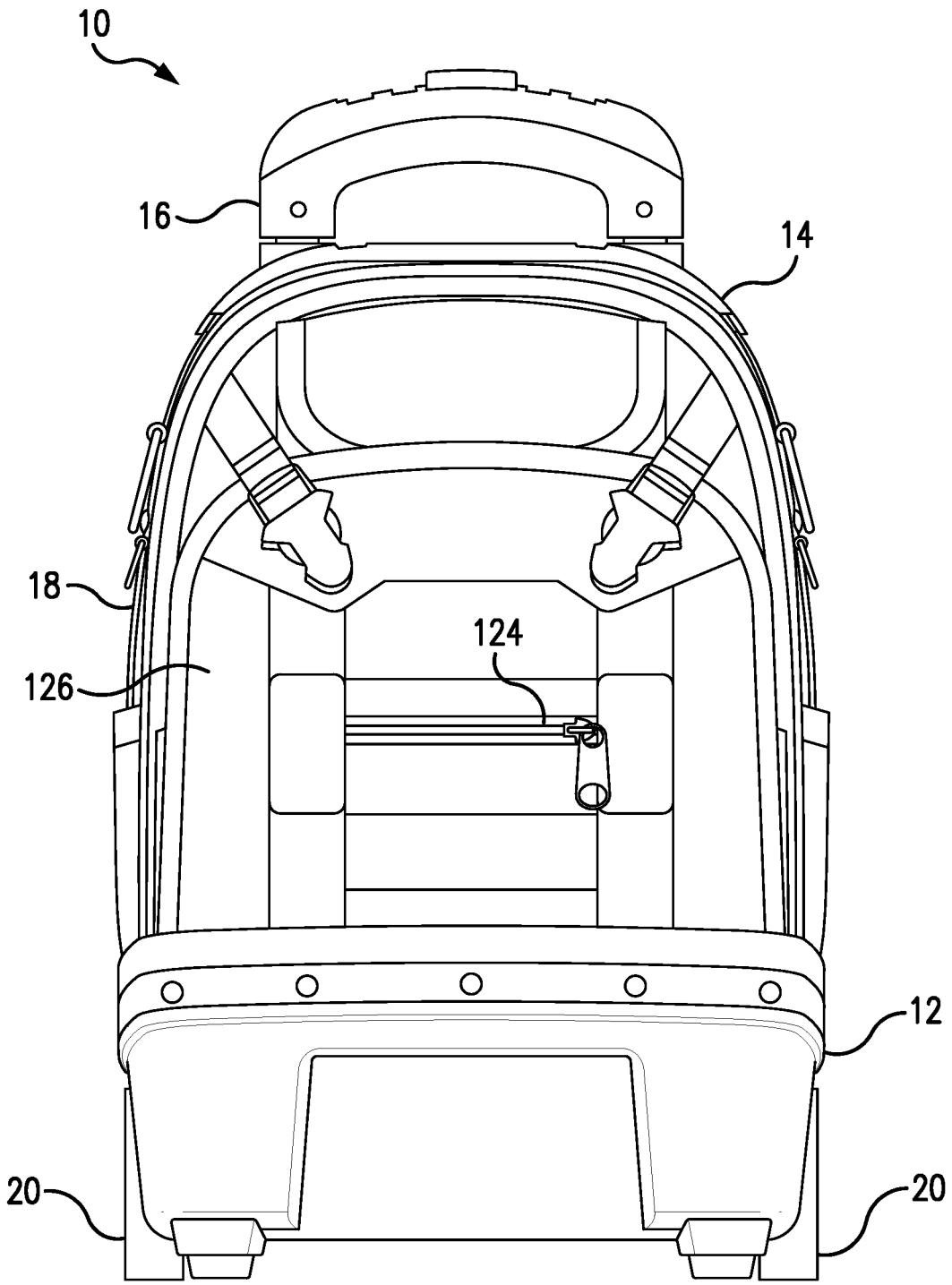
FIG. 1 is a front view of a wheeled carrier incorporating features of the present disclosure.

Referring to FIG. 1, there is shown a front view of a wheeled carrier 10 with telescoping center handle. Although the present disclosure will be described with reference to various exemplary embodiments shown in the drawings, it should be understood that the present disclosure can be embodied in many alternate forms of embodiments. In addition, any suitable size, shape or type of elements or materials could be used.

Figure 2:
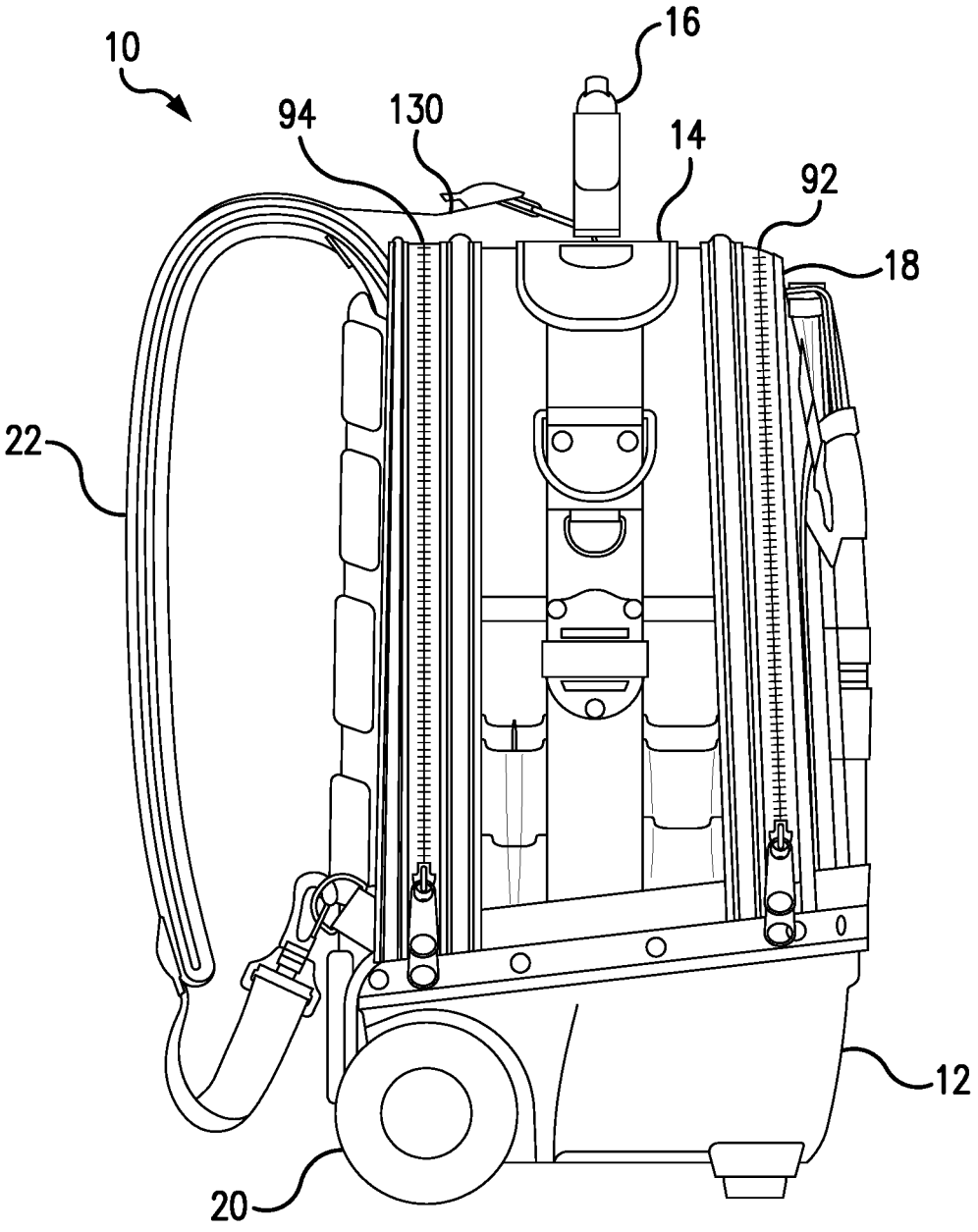
FIG. 2 is a right side view of the wheeled carrier shown in FIG. 1.
Figure 3:
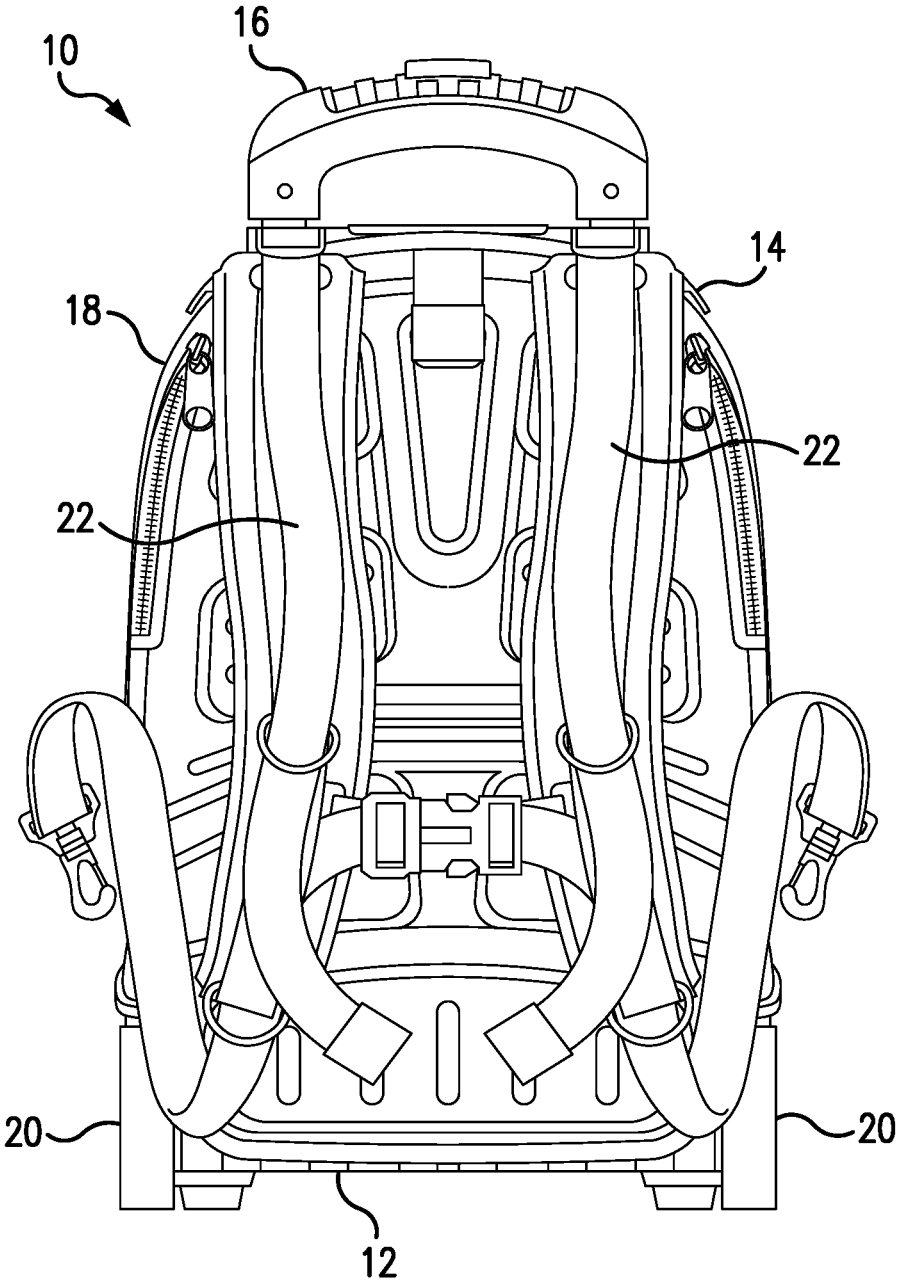
FIG. 3 is a rear view of the wheeled carrier shown in FIG. 1.
Figure 4:
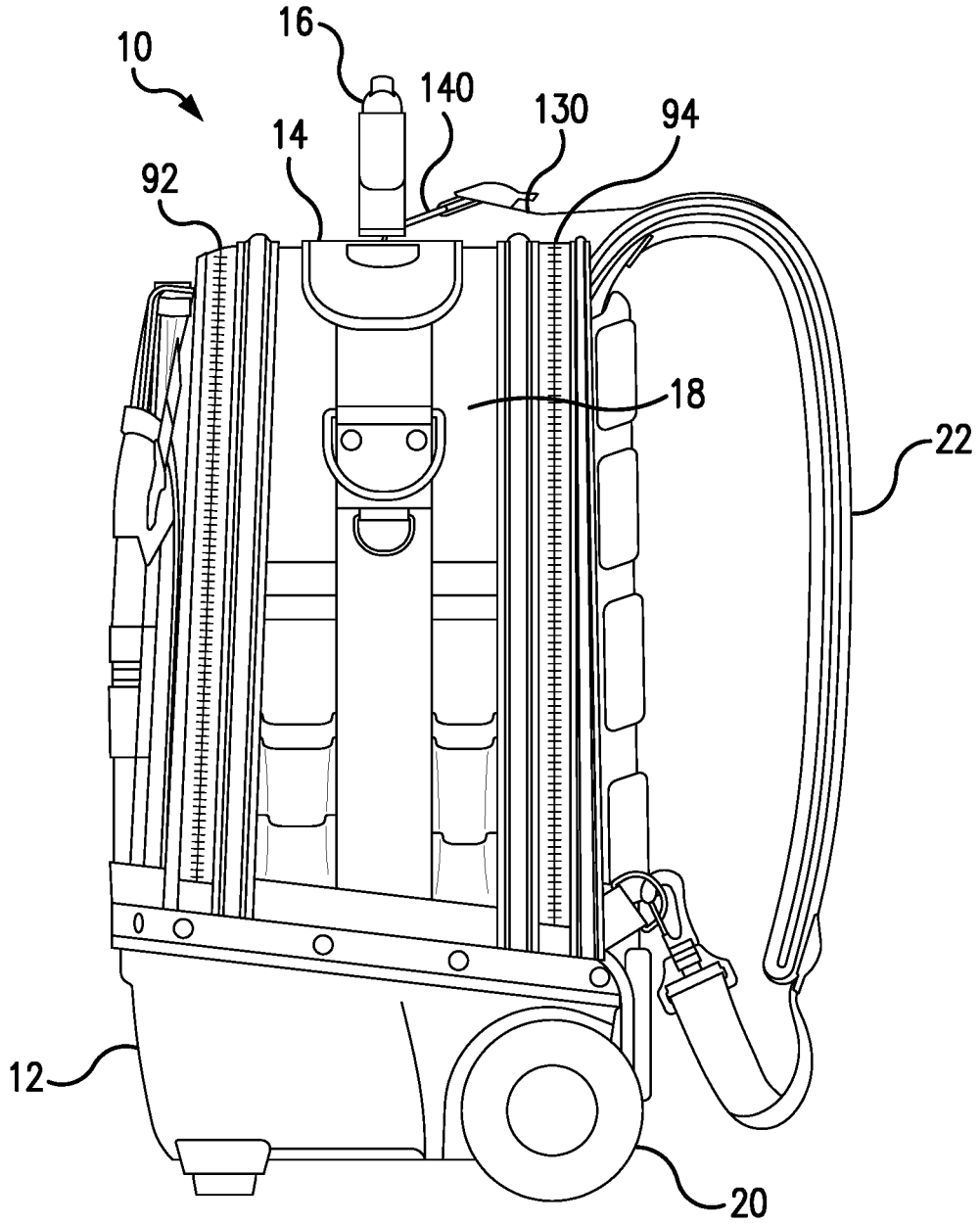
FIG. 4 is a left side view of the wheeled carrier shown in FIG. 1.
Figure 5:
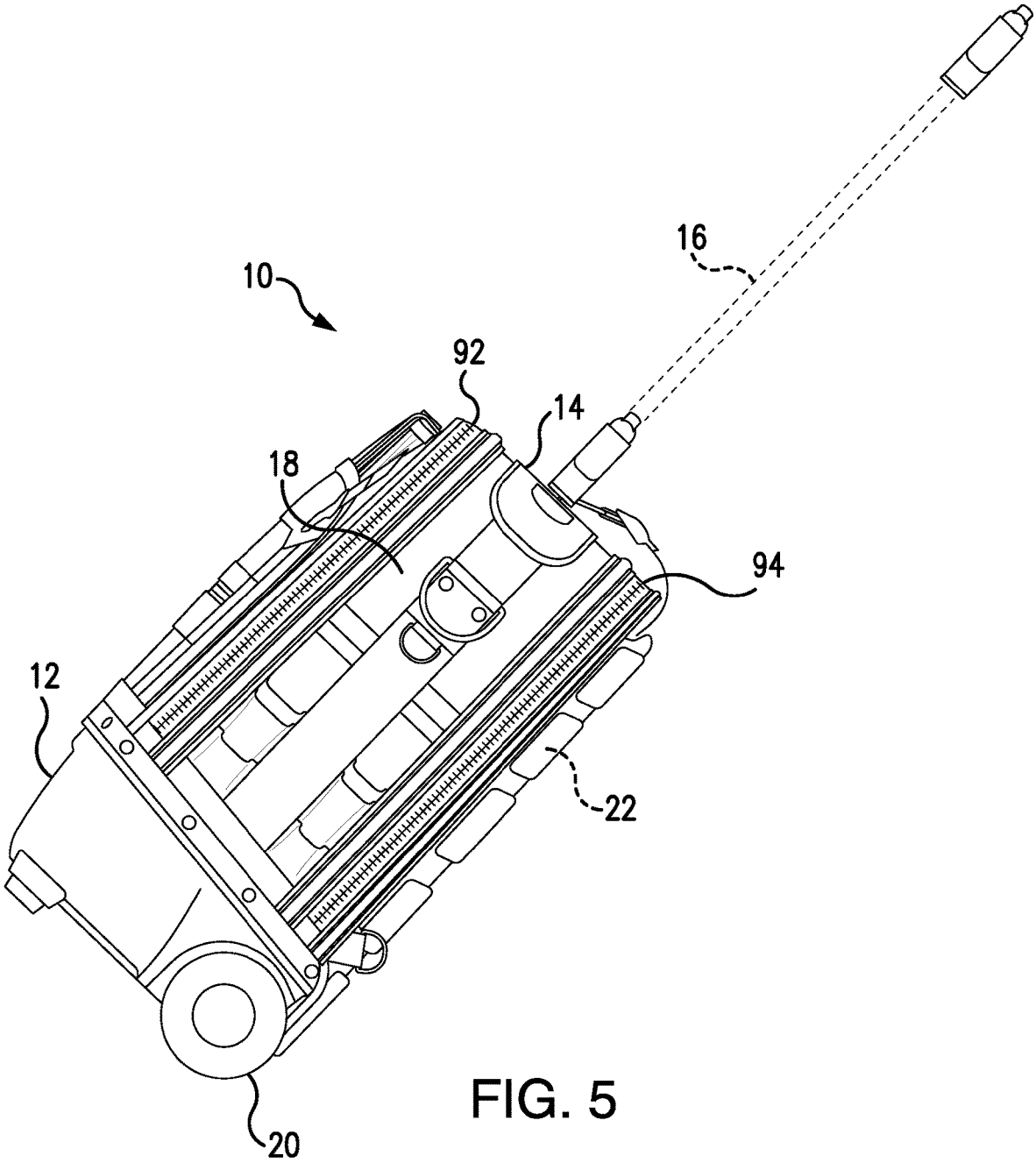
FIG. 5 is a left side view of the wheeled carrier in a rolling configuration.

The wheeled carrier 10 with telescoping center handle can be configured in the form of a backpack [backpack mode] (as shown in FIGS. 2-4) or a wheeled pack [rolling mode] (as shown in FIG. 5). The major components of the carrier 10 are a molded plastic base 12, a support assembly 14, a telescoping center handle assembly 16, a fabric body 18, and a pair of wheels 20. According to various exemplary embodiments the fabric body 18 includes backpack straps 22 permitting the carrier to be worn on the back of a user.

Figure 6:
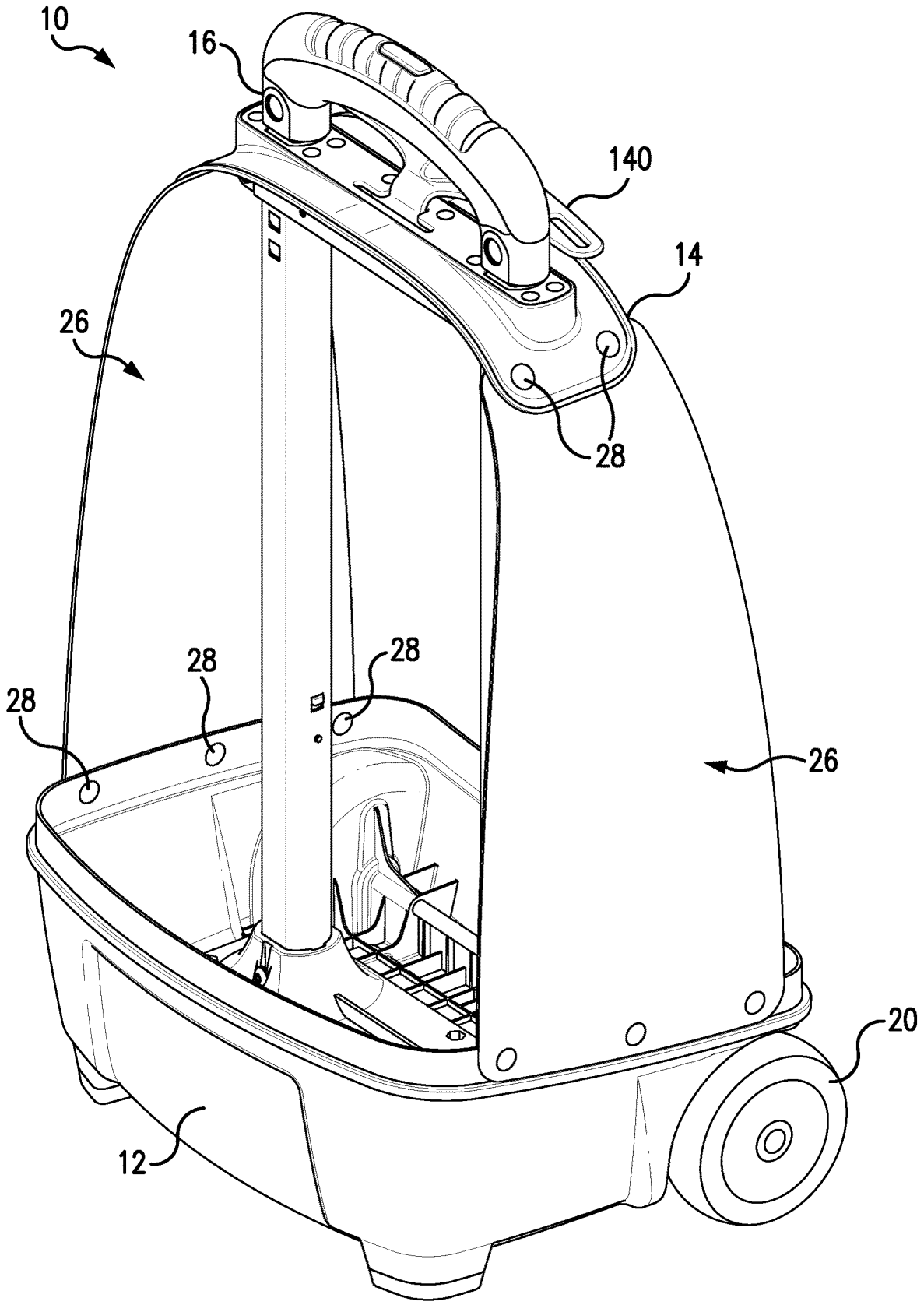
FIG. 6 is a perspective view of the wheeled carrier shown in FIG. 1 (illustrated without a fabric body)
Figure 7:
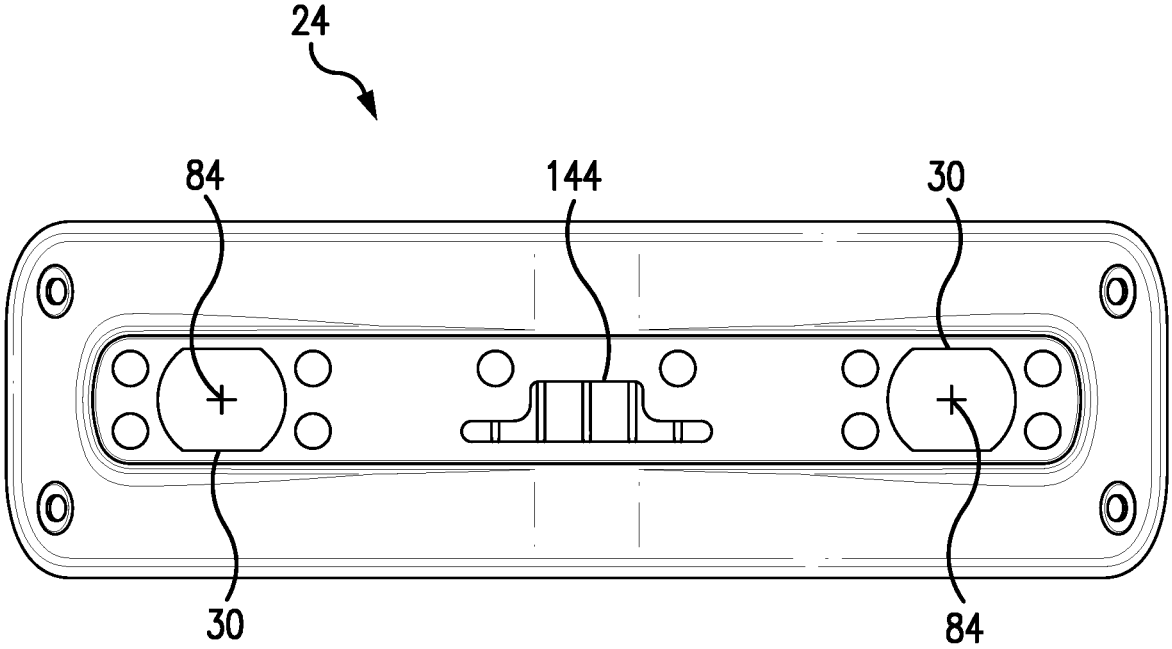
FIG. 7 is a top view of a portion of a support assembly of the wheeled carrier shown in FIG. 1.
Figure 8:
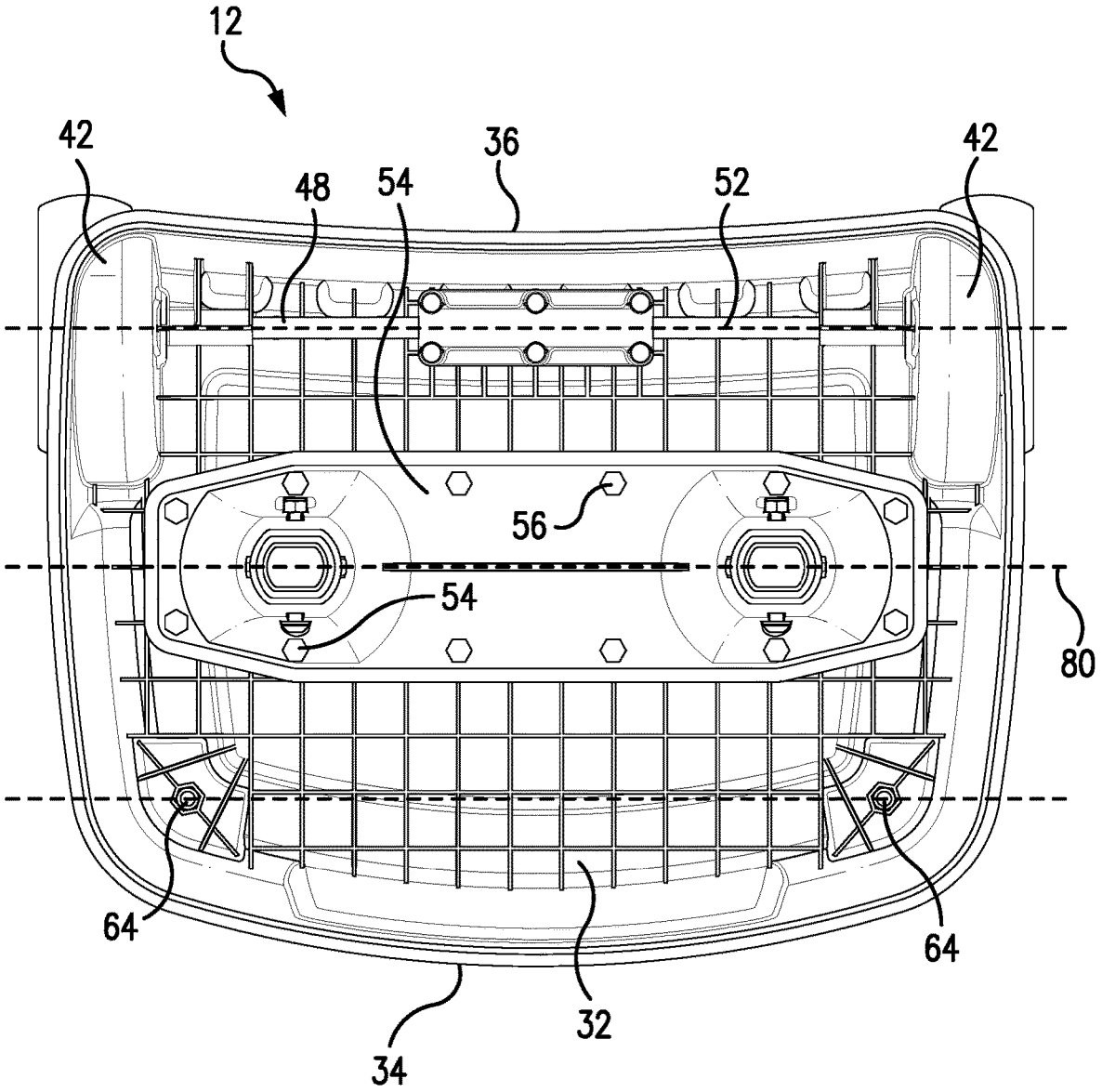
FIG. 8 is a top view of a base of the wheeled carrier shown in FIG. 1.
Figure 9:
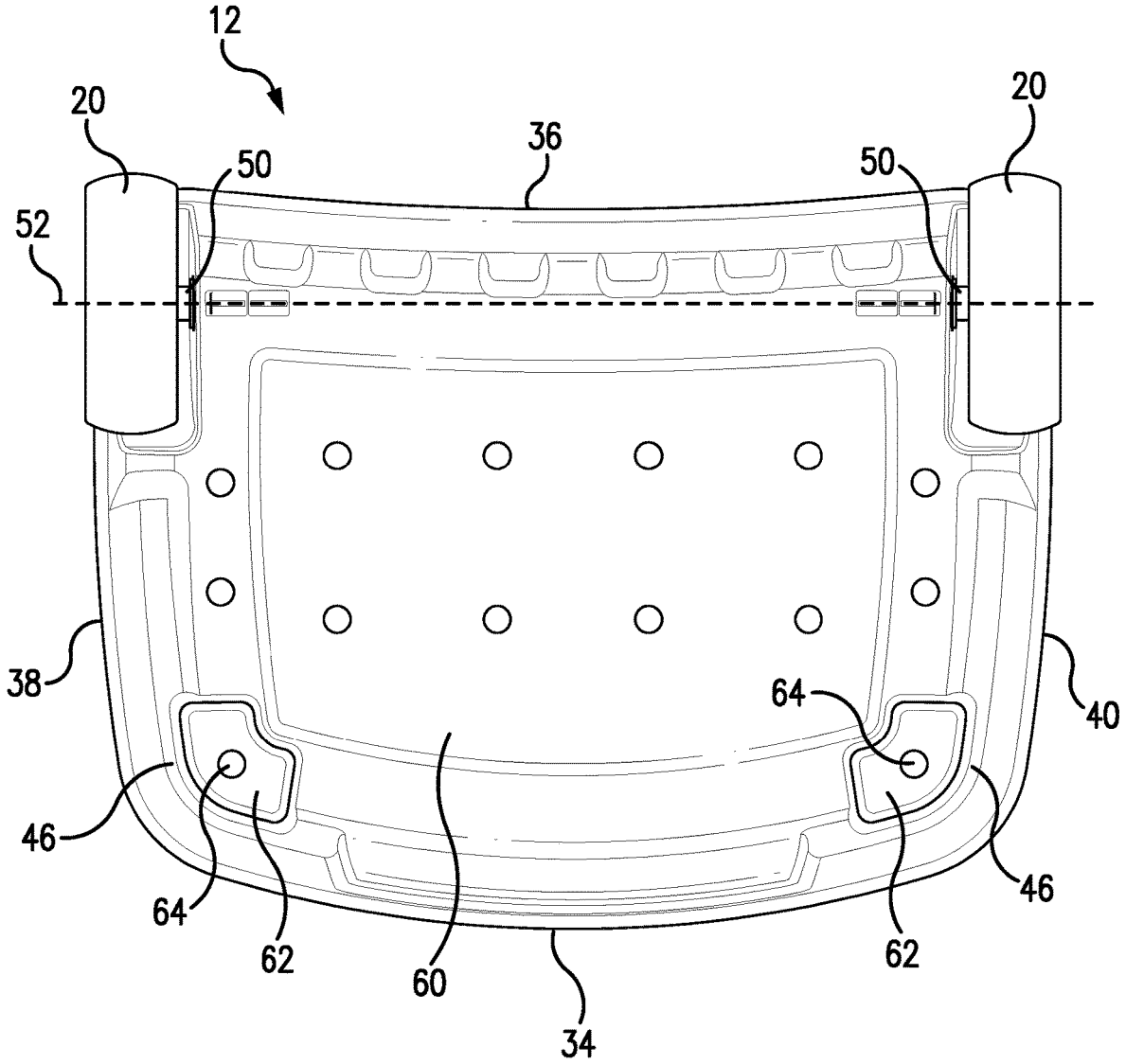
FIG. 9 is a bottom view of the wheeled carrier shown in FIG. 1.
Figure 10:
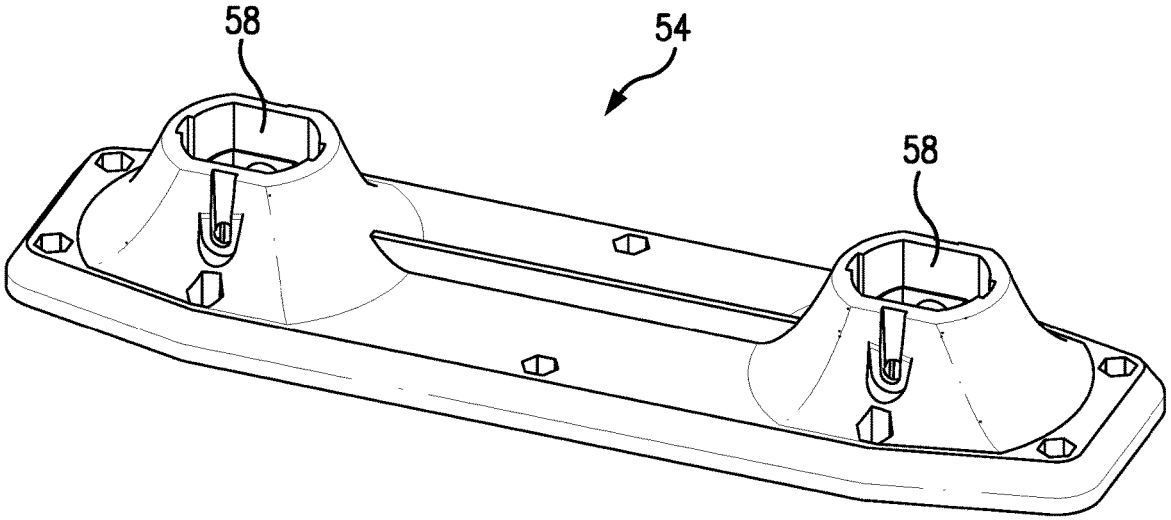
FIG. 10 is a perspective view of a mounting plate of the wheeled carrier shown in FIG. 1.
Figure 11:
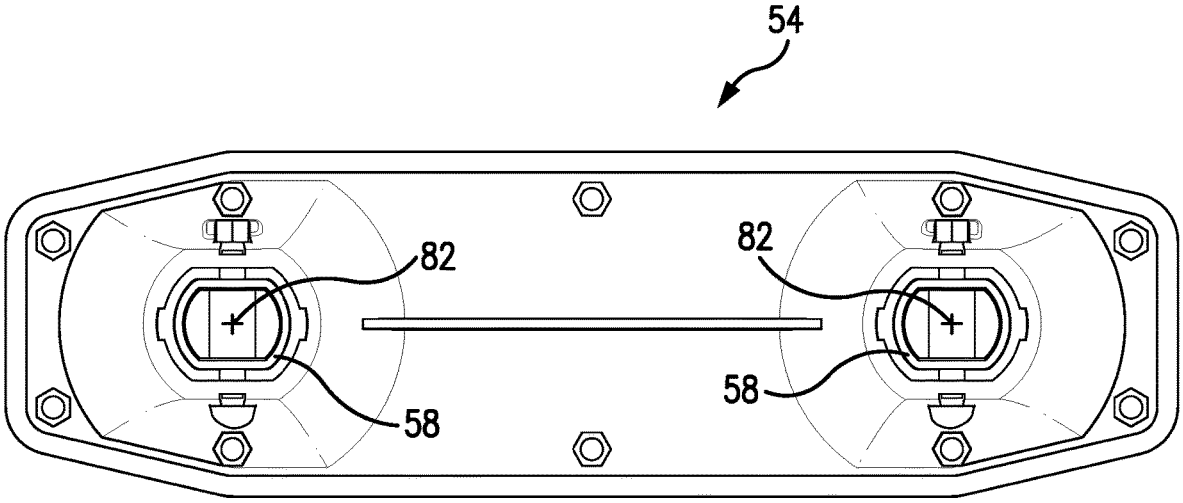
FIG. 11 is a top view of the wheeled carrier shown in FIG. 1.

Referring now also to FIG. 6, the carrier 10 includes both hard and soft structural components. The base 12 of the carrier 10 is a molded plastic tub configured to provide a stable support surface for the carrier while protecting the contents of the carrier from the environment. Although a molded plastic base 12 is disclosed, other manufacturing methods (such as thermoforming) and materials may be used to provide a base according to the disclosure. The support assembly 14 extends from lateral sides of the base 12 to an apex at the top of the carrier 10 opposite the base. The support assembly 14 includes a yoke 24 at the apex and a pair of structural panels 26 extending from the base 12 to the yoke 24. According to various exemplary embodiments, the structural panels 26 are thermal formed Acrylonitrile Butadiene Styrene (ABS) panels which are secured to the base and yoke by rivets 28 or other suitable fastener. However, in alternate embodiments other manufacturing or attachment methods may be provided. The yoke 24 comprises openings 30 (see FIG. 7) which are sized and shaped to allow the telescoping handle 16 to extend therethrough. With the configuration of the openings 30, the panels 26 and the yoke 24 form a brace providing structural support for the handle 16 such that forces from the handle are transmitted to the base 12 and wheels 20. The fabric body 18 is constructed of heavy duty nylon and polypropylene materials to protect the carrier contents and hold up in jobsite conditions. In the disclosed embodiment, the base 12, the structural panels 26, and the yoke 24 form a substantially rigid supportive structure with the fabric body 18 extending between the base 12 and the yoke 24 (and around the structural panels 26) to form an outer wall of the carrier 10.

Referring now also to FIGS. 8-13, the base 12 comprises a bottom surface 32, a first end (or front end) 34, a second end (or rear end) 36, a first lateral side 38, and a second lateral side 40. The base 12 further comprises wheel wells 42, a mounting plate receiving area 44, and foot receiving areas 46. The wheel wells 42 are provided at the lateral sides 38, 40 of the base 12 and are proximate the second end 36 of the base 12. The wheel wells 42 are sized and shaped to receive the wheels 20 with a clearance therebetween. The wheels 20 are mounted to an axle 48 extending through openings 50 in the wheel wells 42. The wheels 20 are configured to rotate about a central axis (or rotational axis) 52 (see FIG. 8) of the axle 48.

The mounting plate receiving area 44 is at the bottom surface 32 of the base 12. The mounting plate receiving area 44 is sized and shaped to allow for securing of mounting plate 54 thereon with screws 56 or any other suitable fastener. The mounting plate 54 is substantially centered relative to the bottom surface 32 of the base between the first and second ends 34, 36 of the base 12. The mounting plate 54 comprises a general flat rectangular shape with raised boss sections having openings 58 which are sized and shaped to receive a stationary portion of the handle assembly 16 (see FIG. 12).

The foot receiving areas 46 are at a bottom side 60 of the base 12 and disposed proximate the first end 34 and the lateral sides 38, 40 of the base 12. The foot receiving areas 46 are sized and shaped to allow for securing of feet 62 (see FIGS. 9, 13) thereon with screws 64 or any other suitable fastener. The feet 62 are generally opposite the wheels 20 (relative to the base 12) and allow the carrier 10 to be maintained in an upright position when the carrier 10 is placed down or otherwise at rest on a surface. It should be noted that in alternate embodiments the feet could be integral or co-molded (or over-molded) with the base.

Figure 12:
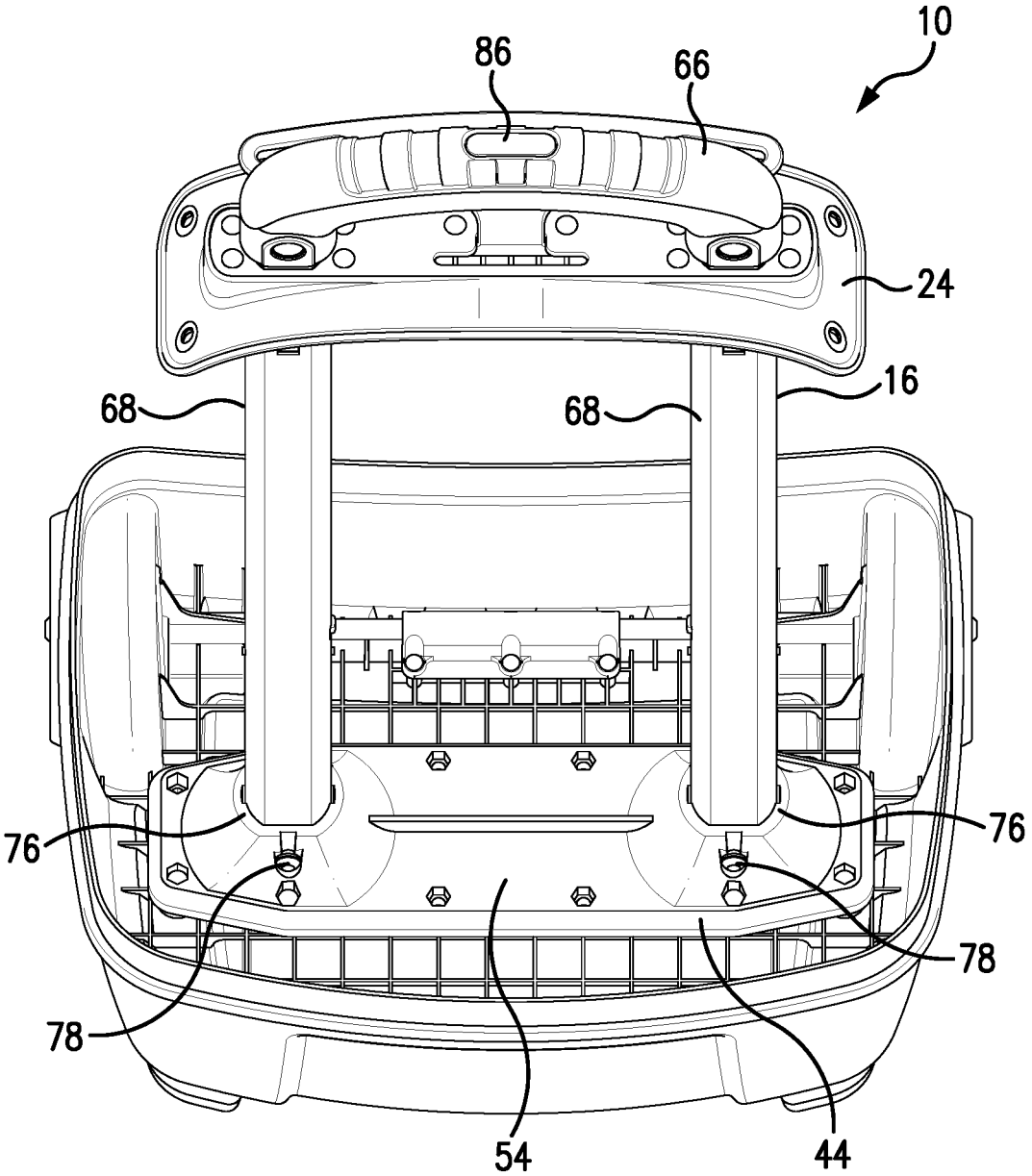
FIG. 12 is another perspective view of the wheeled carrier shown in FIG. 1 (illustrated without the fabric body)
Figure 13:
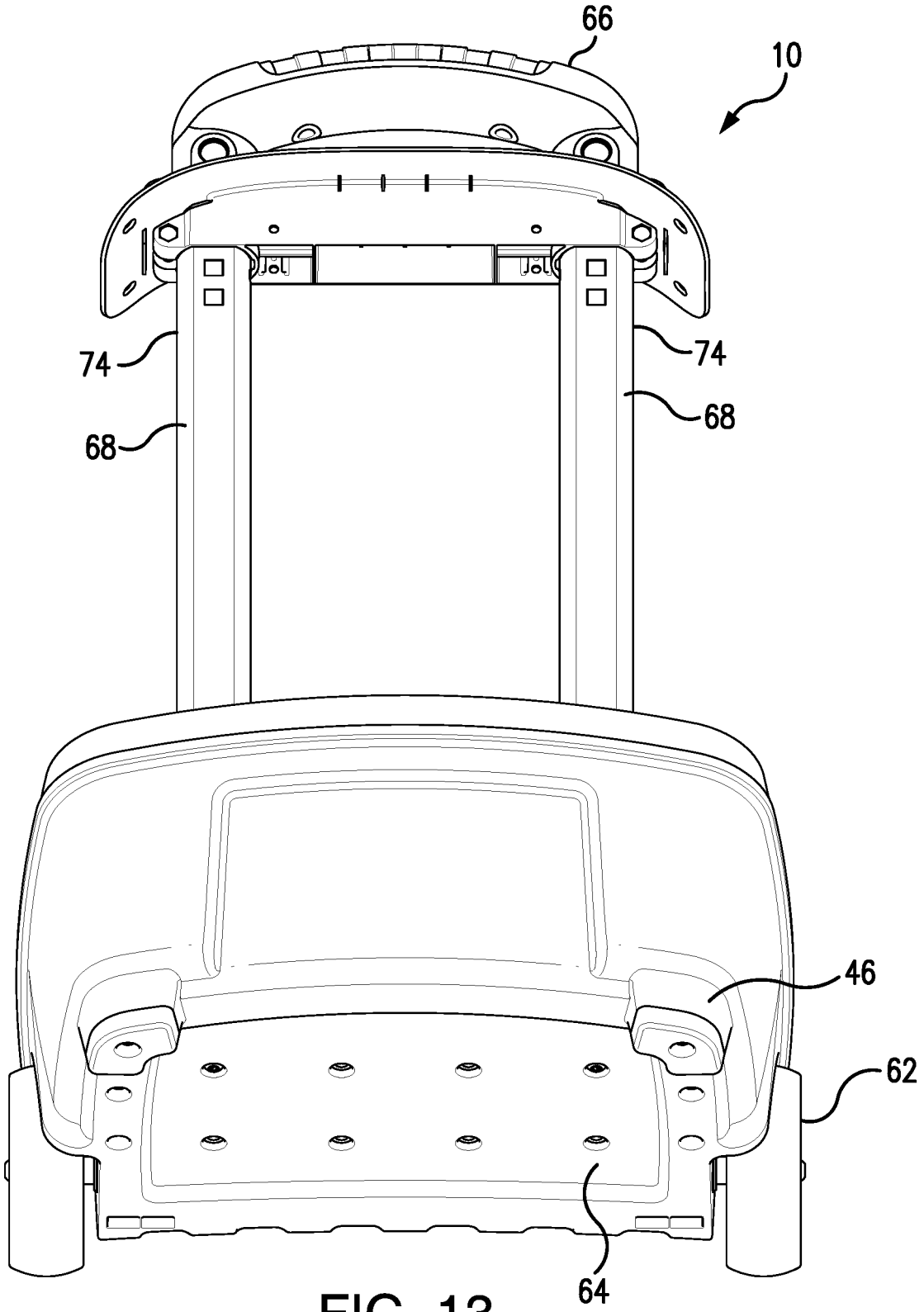
FIG. 13 is another perspective view of the wheeled carrier shown in FIG. 1 (illustrated without the fabric body)
Figure 14:
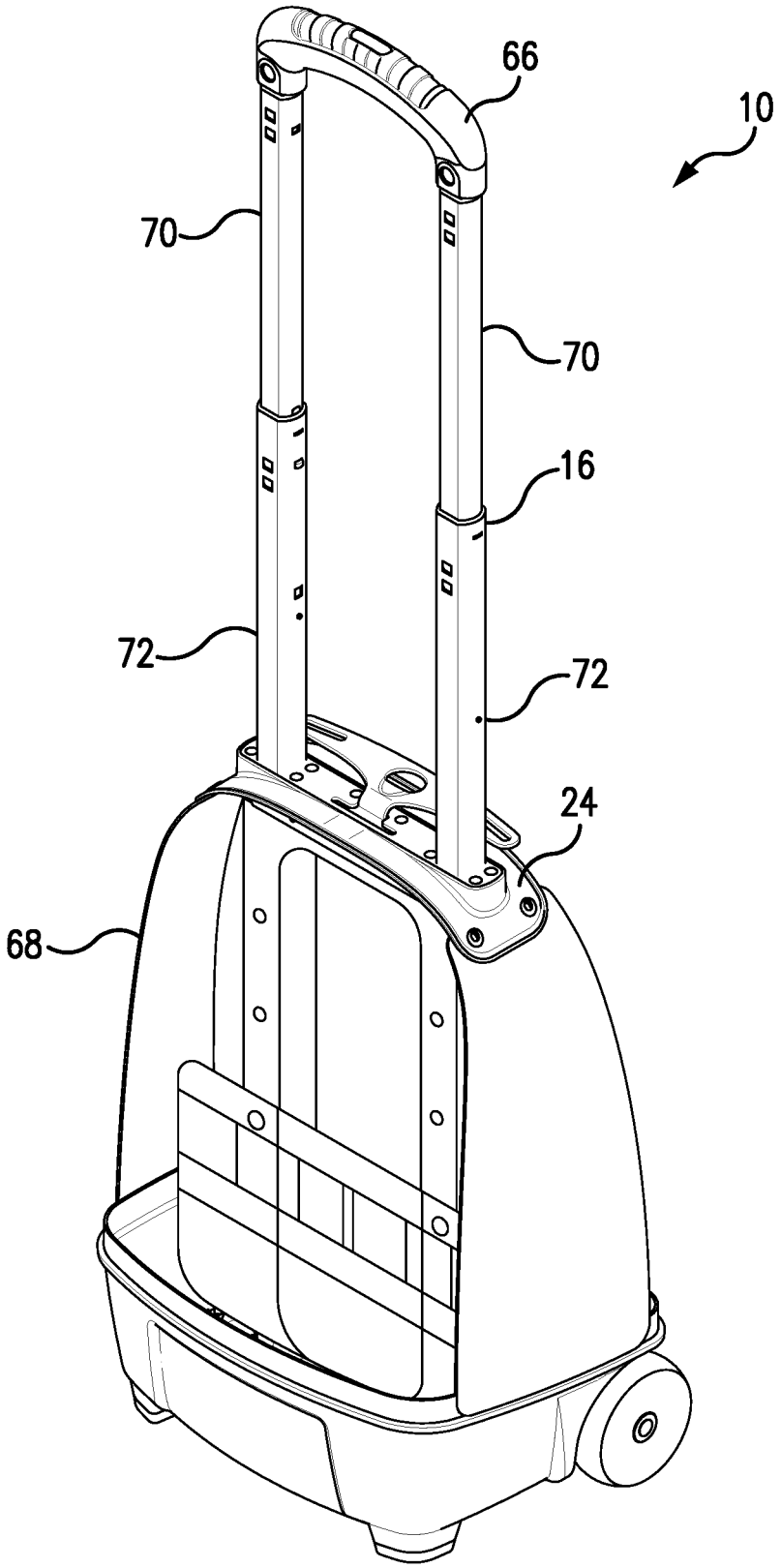
FIG. 14 is a perspective view of the wheeled carrier shown in FIG. 1 with an installed pocket sleeve panel (illustrated without the fabric body)

As best shown in FIGS. 12-14, the center handle assembly 16 comprises a handle portion 66, stationary legs 68, first movable legs 70, and second movable legs 72. The stationary legs 68 are fixedly secured between the yoke 24 and the mounting plate 54. First ends 74 of the stationary legs 68 are received proximate the openings 30 of the yoke 24, and opposite second ends 76 of the stationary legs 68 are fixedly connected to the mounting plate 54 (at the openings 58). The stationary legs 68 are secured to the openings 58 of the mounting plate 54 by screws 78 (or any other suitable fastener) to allow for easy removal and/or replacement of the center handle assembly 16. The first movable legs 70 are connected to the handle portion 66 and the second movable legs 72 are movably connected between the stationary legs 68 and the first movable legs 70.

According to various exemplary embodiments the stationary legs 68 and the movable legs 70, 72 have a hollow (or tubular) shape such that the second movable legs 72 have a slightly smaller cross-section shape than the stationary legs 68 (allowing for the second movable legs 72 to be slidably received within the stationary legs 68) and the first movable legs 70 have a slightly smaller cross-section shape than the second movable legs 72 (allowing for the first movable legs 70 to be slidably received within the second movable legs 72). The slidable connection between the stationary legs 68 and the second movable legs 72, and the slidable connection between the second movable legs 72 and the first movable legs 70 provide for a telescoping arrangement of the handle assembly 16.

While various exemplary embodiments have been described in connection with the second movable legs 72 slidably connected between the stationary legs 68 and the first movable legs 70, one skilled in the art will appreciate that the various exemplary embodiments are not necessarily so limited and that alternate embodiments may comprise any other suitable slidable (or extendable) configuration between the movable legs and the stationary legs.

The legs 68, 70, 72 are disposed along a central plane 80 of the center handle assembly 16. The central plane 80 (see FIG. 8) is defined by center points 82 (see FIG. 11) of the openings 58 of the mounting plate 54 and center points 84 (see FIG. 7) of the openings 30 of the yoke 24 such that the plane 80 is substantially perpendicular to the bottom surface 32 of the base 12. The first and second movable legs 70, 72 slidably extend from the stationary legs 68 (along the central plane 80) as shown in FIGS. 5, 14. With the mounting plate 54 substantially centered relative to the base 12, this provides for the central plane 80 to be between the first end 34 of the base 12 and the central axis 52 of the wheels 20. Additionally, the central plane 80 is substantially centered between the central axis 52 and mounting points (see screws 64) of the feet 62 (best shown in FIG. 8). According to various exemplary embodiments, the central plane 80 may have positions forward or rearward of the substantially centered position described above. However, the central plane is always spaced from the rotational axis of the wheels, and defines a compartment between the rotational axis of the wheels and the center handle assembly 16.

According to some embodiments, the center handle assembly 16 may further comprise a depressible button 86 configured to unlock the movable legs 70, 72 relative to the stationary legs 68 when moving between collapsed (FIGS. 6, 12, 13) and extended positions (FIGS. 5, 14).

Figure 15:
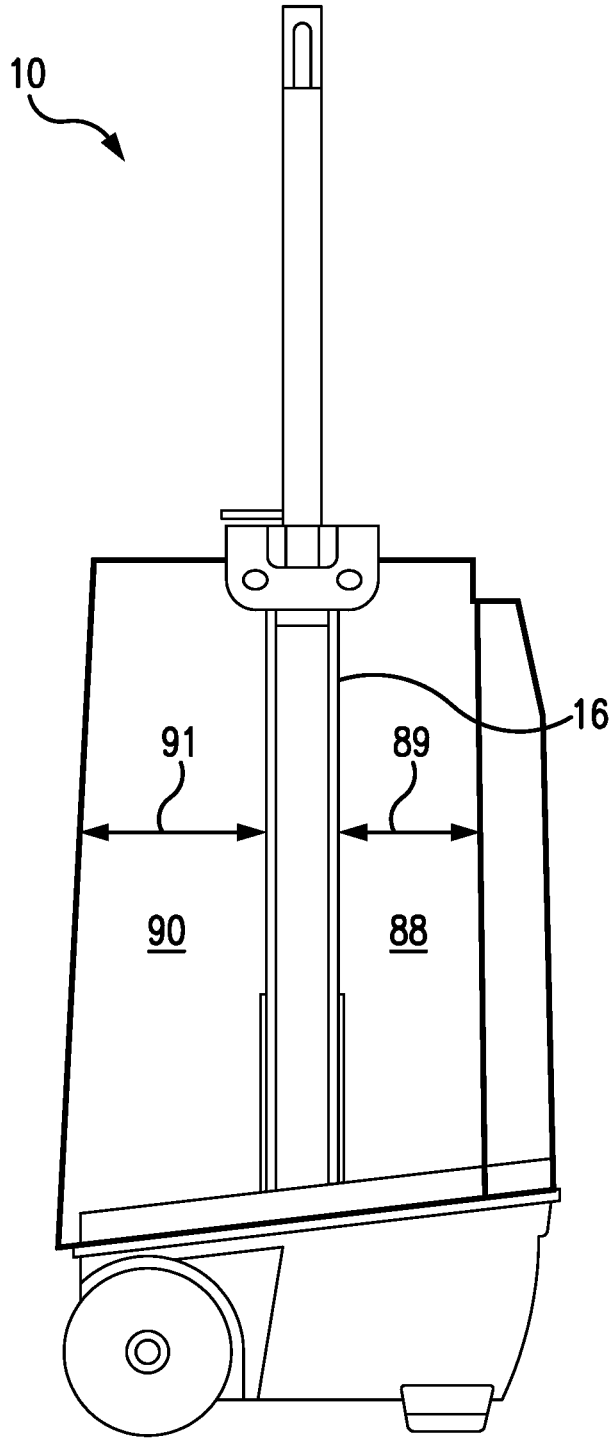
FIG. 15 is a partial section view taken from the right side of the wheeled carrier shown in FIG. 1.
Figure 16:
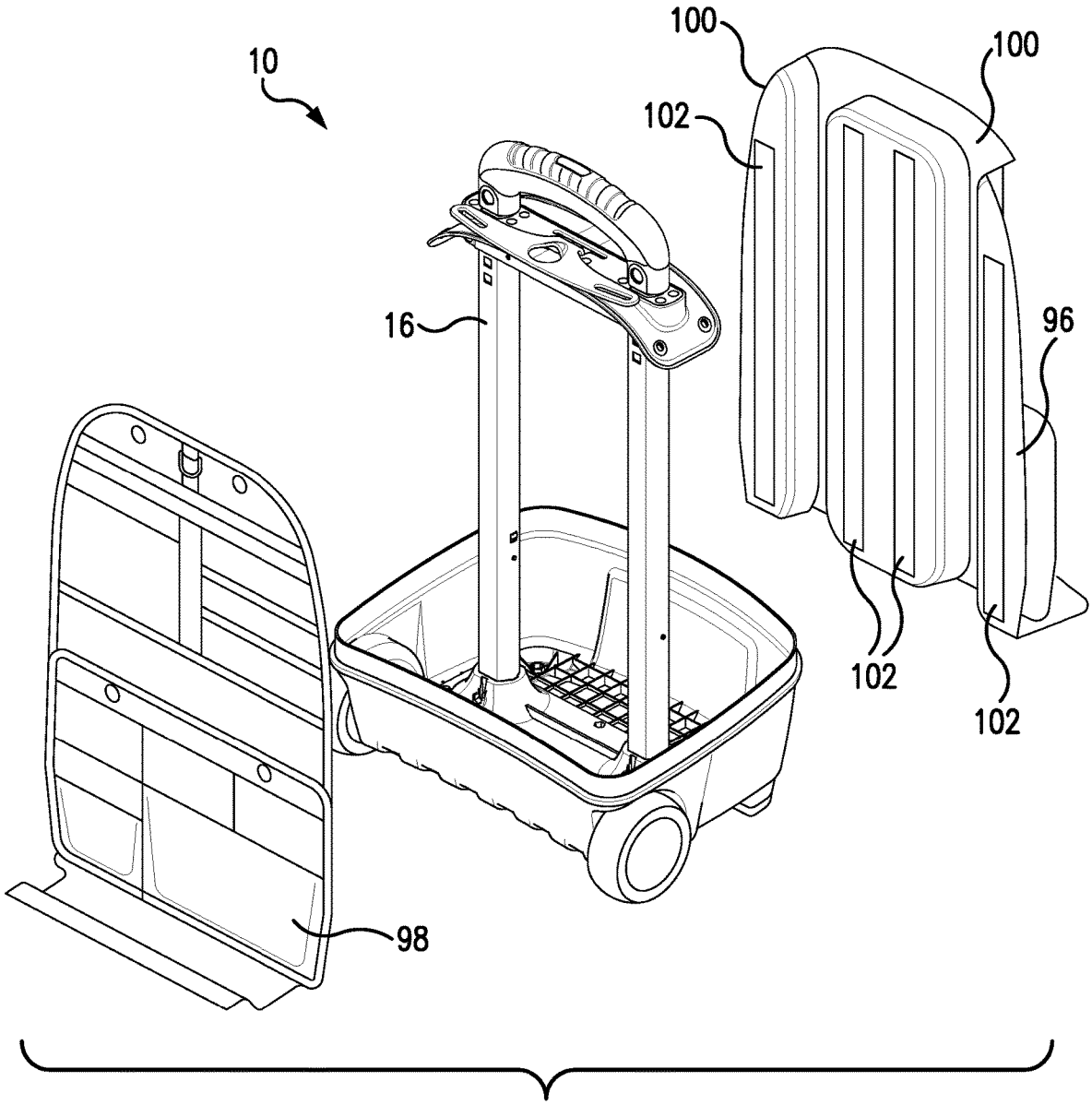
Figure 17:
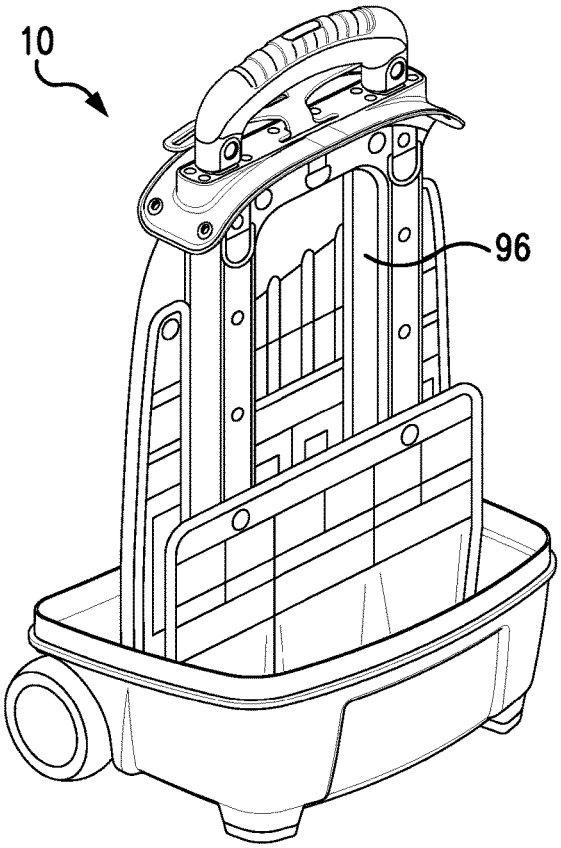
Figure 18:
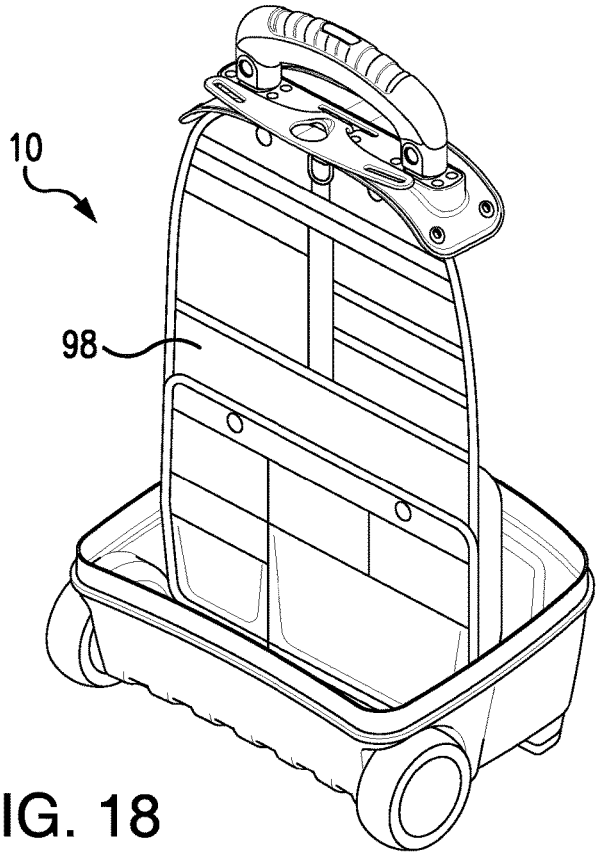

Referring now also to FIG. 15, the center handle assembly 16 divides the carrier 10 into two primary compartments, a front compartment 88 and a rear compartment 90. As best shown in FIGS. 2, 4, and 5, the disclosed carrier 10 includes two primary zippers 92, 94 allowing access to the two primary compartments, 88, 90 of the carrier 10. Each compartment 88, 90 includes at least one surface for the organization of tools, cables, parts and components and other work implements. As shown in FIGS. 16-18, two pocket sleeve panels 96, 98 are arranged back-to-back on either side of the center handle assembly 16, and together with the center handle assembly form a divider extending the height and width of the carrier 10.

Figure 19:
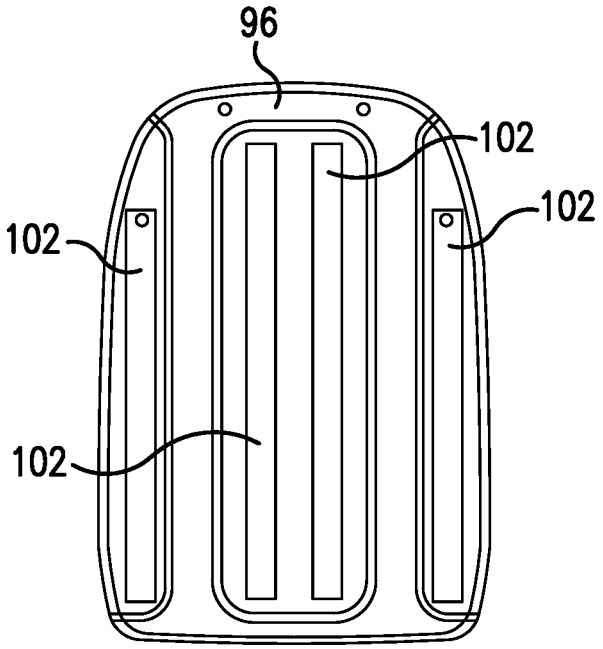
Figure 20:
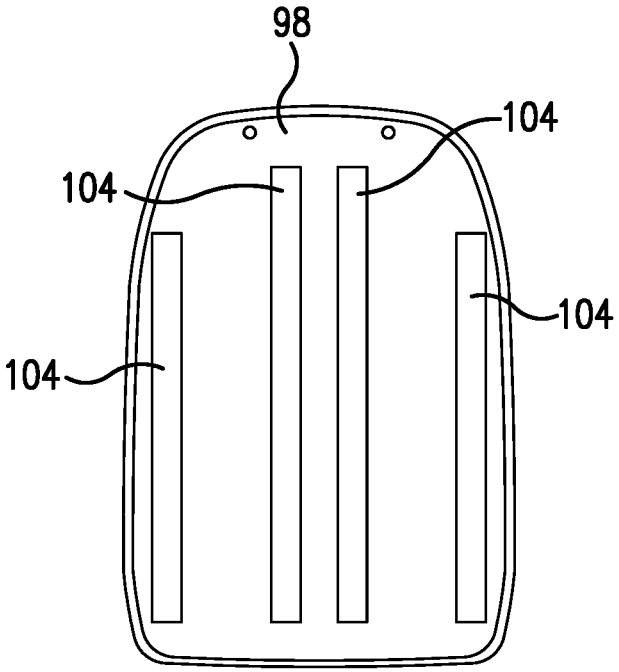
Figure 21:
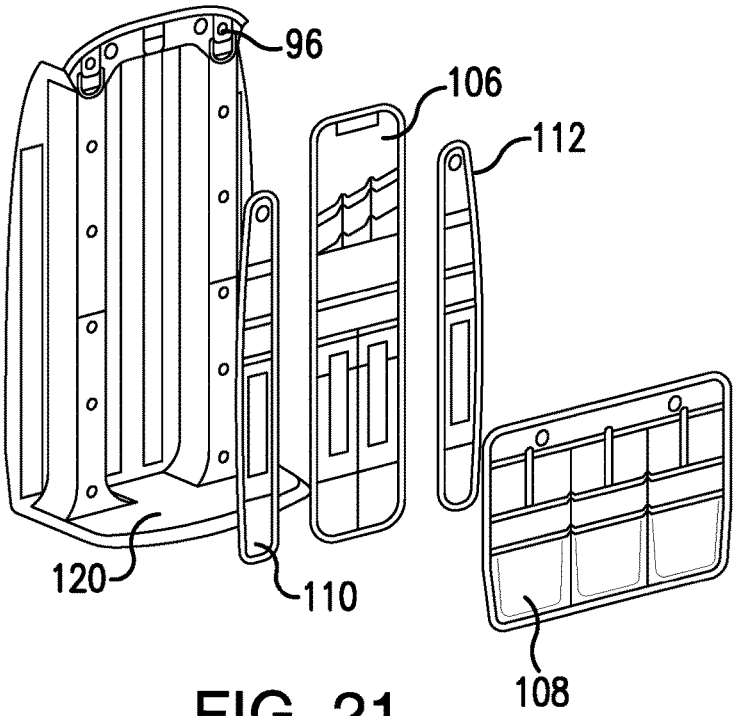
Figure 22:
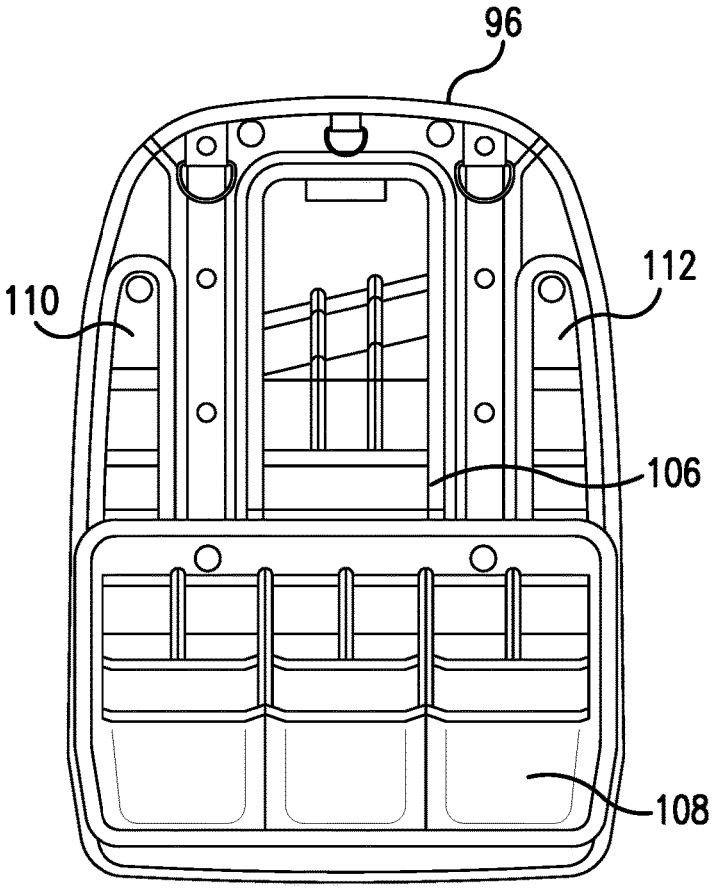
Figure 23:
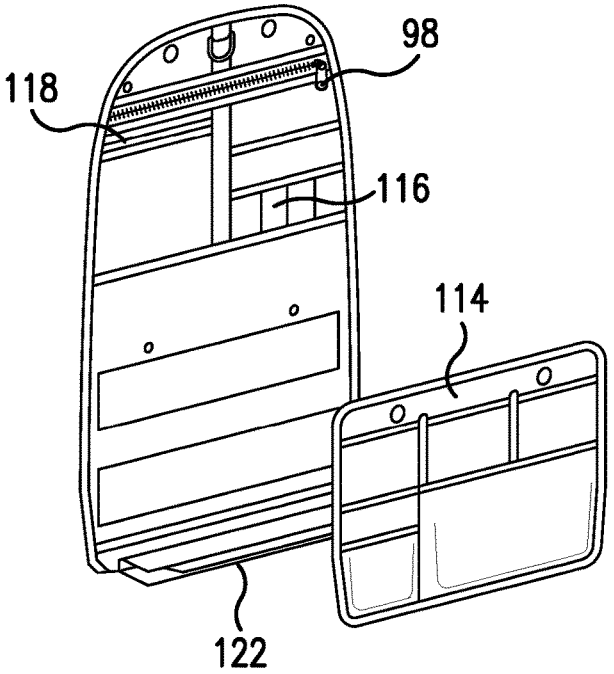
Figure 24:
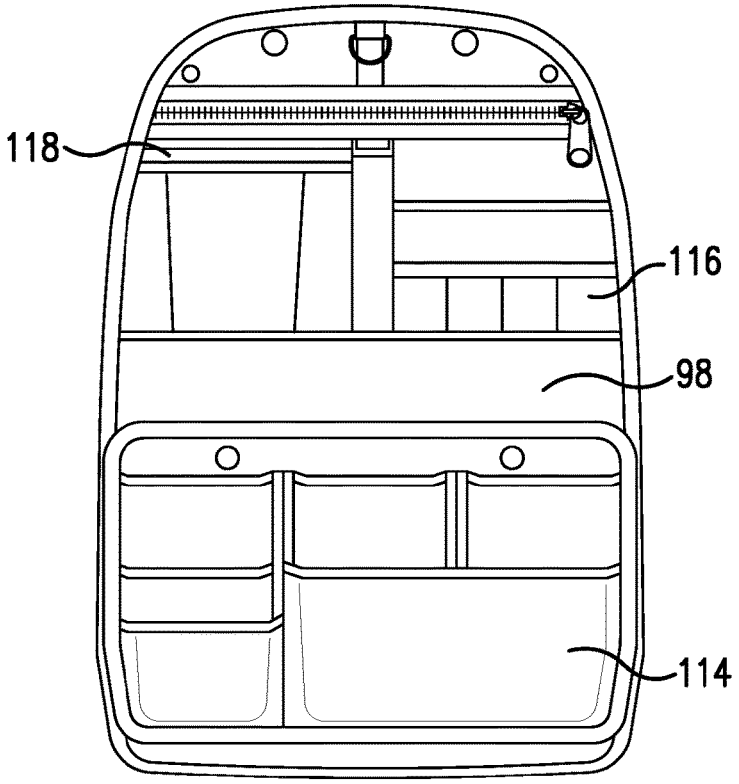

The replaceable pocket sleeve panels 96, 98 are sized and shaped to have grooves configured to fit around the center handle assembly legs 68. For example in the embodiment shown in FIGS. 16-20 the replaceable pocket sleeve panel 96 comprises grooves 100 and the replaceable pocket sleeve panel 98 comprises a general flat shape. However in alternate embodiments, the replaceable pocket sleeve panel 98 may comprise grooves and the replaceable pocket sleeve panel 96 may comprise a general flat shape. Additionally, the replaceable pocket sleeve panels 96, 98 are secured on either side of the center handle assembly with hook and loop fasteners 102, 104 on respective back sides of the replaceable pocket sleeve panels (see FIGS. 16, 19, 20). As best seen in FIGS. 16 and 17, the shape of the pocket sleeve panel 96 permits use of the space between the stationary legs 68 as additional compartment space. This is provided by the grooves 100 that are sized and shaped to be fitted around the stationary legs 68.

The configuration of the base 12, the center handle assembly 16, and the support assembly 14 is stiff enough to support the body 18 and the contents of the carrier 10 in a vertical orientation when the carrier 10 is at rest. The base 12, the center handle assembly 16, and the support assembly 14, in combination with the body 18, result in an upright and stable configuration which protects the contents of the carrier 10, while providing easy access to its contents. The upright nature of the carrier 10 prevents all or parts of the body 18 from falling to the floor or ground where it can be soiled or damaged by the jobsite environment.

According to various exemplary embodiments, the panels 96, 98 may be constructed of 3-4 mm honeycomb ABS (corrugated ABS). However, in alternate embodiments the panels may be constructed of any other suitable material(s). As best seen in FIGS. 21-24 pockets 106, 108, 110, 112, 114 are arranged (with hook and loop fasteners, for example) on panels 96, 98, with the largest pockets 108, 114 at the bottom of each panel. The pockets are constructed to provide a range of sizes and orientations for the storage of various tools, parts and equipment and work implements. In the disclosed embodiment, the pockets are situated so that the heaviest and bulkiest items may be situated in the large pockets at the bottom of the carrier but are easily accessible via the two main zipper openings 92, 94. Each panel 96, 98 also may include flat pockets 116 and zippered enclosures 118 for the storage of flat and or less bulky items toward the top of the carrier without obstructing the view of and access to the larger items at the bottom of the carrier. Bottom portions 120, 122 of the panels 96, 98 may extend along, and configured to be arranged against, the bottom of the base 12. The configuration of the base 12, the center handle assembly 16, the support assembly 14, and the panels 96, 98 ensure that the carrier remains upright even when the internal pockets are loaded with heavy tools and equipment and work implements.

The fabric body 18 extends from the base 12 to the yoke 24 at the top of the carrier 10. According to various exemplary embodiments the fabric body 18 may be constructed of durable nylon and polypropylene fabric and webbing materials. These materials are preferred because of their abrasion resistance, strength, and resistance to rot and mildew as well as many common lubricants and solvents present at worksites. Other materials having similar properties may be employed. The fabric body 18 consists of fabric panels stitched together and secured to webbing support to surround and enclose the two primary compartments 88, 90 of the carrier. As best seen in FIG. 1 the front of the fabric body includes one or more small zippered compartments 124 for quick access. A larger zippered compartment 126 on the front of the carrier can accommodate larger items for quick access. The exterior of the fabric body 18 may further include a variety of other fabric pockets, zipper pockets, or D rings for additional storage and/or attachment of tools or materials.

Figure 25:
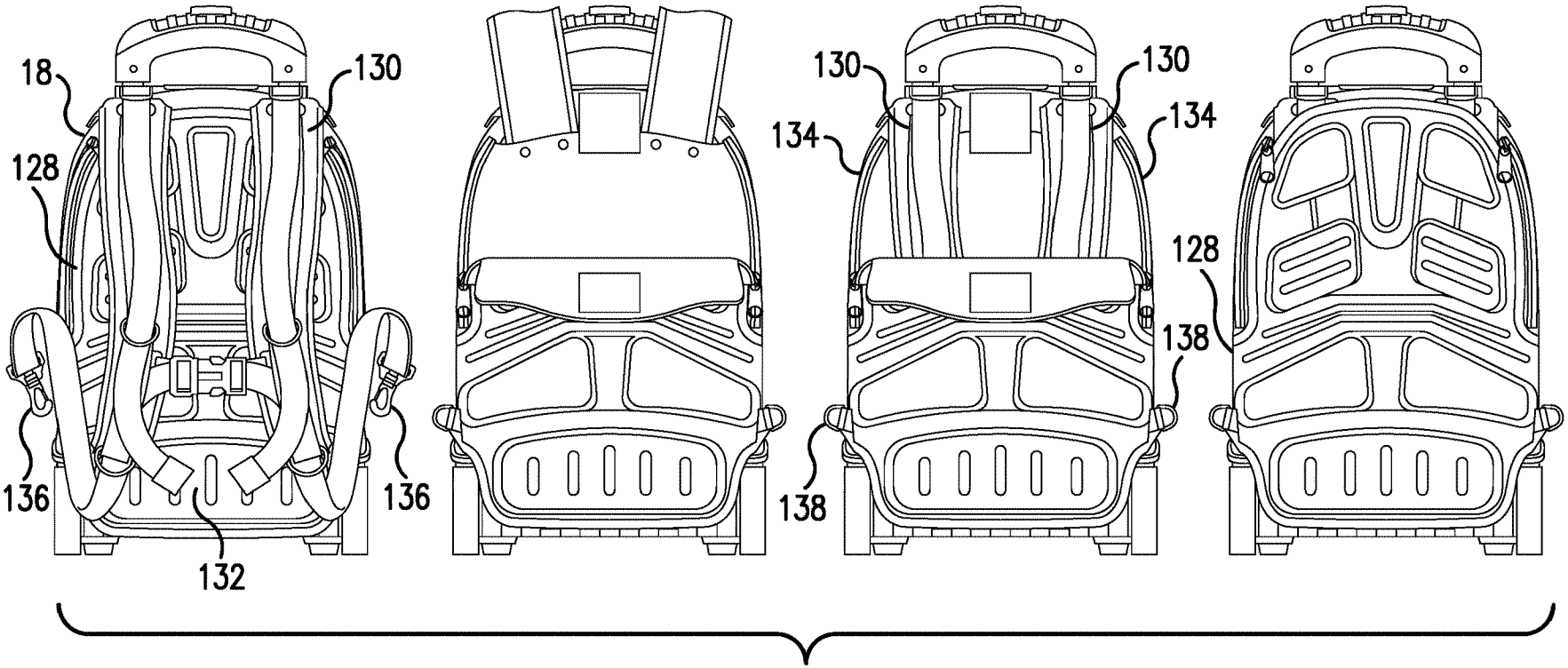
FIG. 25 shows various views of the wheeled carrier shown in FIG. 1 when transformed from a backpack configuration to a rolling configuration.
Figure 26:
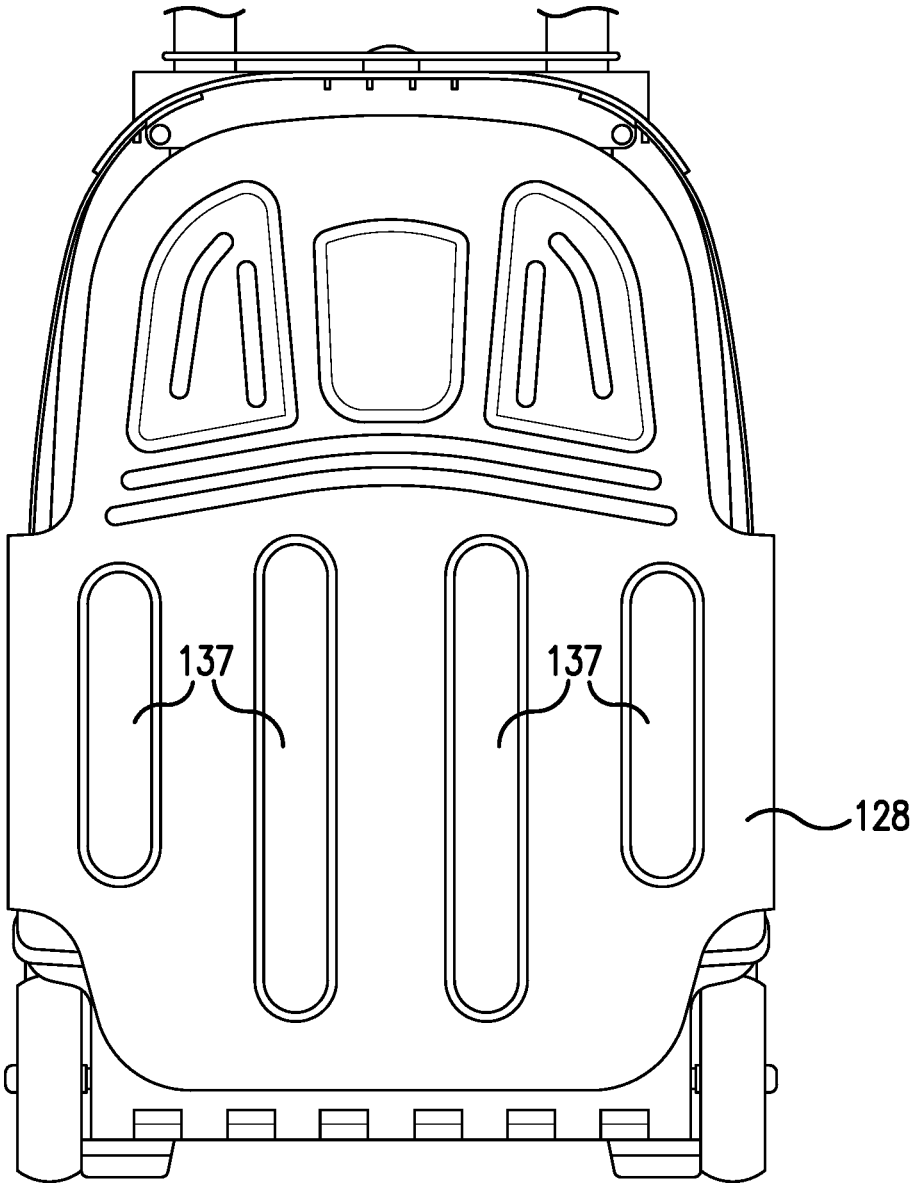
FIG. 26 is a rear view of an exemplary embodiment of the wheeled carrier shown in FIG. 1.

As best seen in FIG. 25, the rear of the fabric body 18 includes a padded back panel 128 and backpack straps 130 with sternum strap 132. Zippered portions 134 between the fabric body 18 and the padded back panel 128 allow for storing of the straps 130 within zippered compartments when converting the carrier from the backpack mode to rolling mode (see numerals 1-4 in FIG. 25). According to various exemplary embodiments the padded back panel 128 may comprise a thermoformed foam back cushion which improves the comfort of the carrier during use (in backpack mode) and includes air channels to circulate air between the user and the carrier. With this configuration, the backpack straps 130 are easily accessible (by the zippers 134) when it is desired to return the carrier from rolling mode to backpack mode. The backpack straps 130 may be secured directly to the top of the fabric body 18 and secured by metal snap hooks 136 to sides of the fabric body 18 at rings 138. The sternum strap 132 with quick release connector is arranged to extend between the backpack straps 130 across the chest of a user as additional support for the carrier during use. The backpack straps 130 are constructed of heavy gauge durable fabric surrounding foam padding material. According to some alternate embodiments, the padded back panel 128 may further comprise molded rub rails 137 (see FIG. 26). The molded rub rails 137 (which project from the padded back panel to a suitable height) are configured to protect the carrier 10 when being dragged up stairs and/or over tall curbs (i.e. when in the rolling mode).

Figure 27:
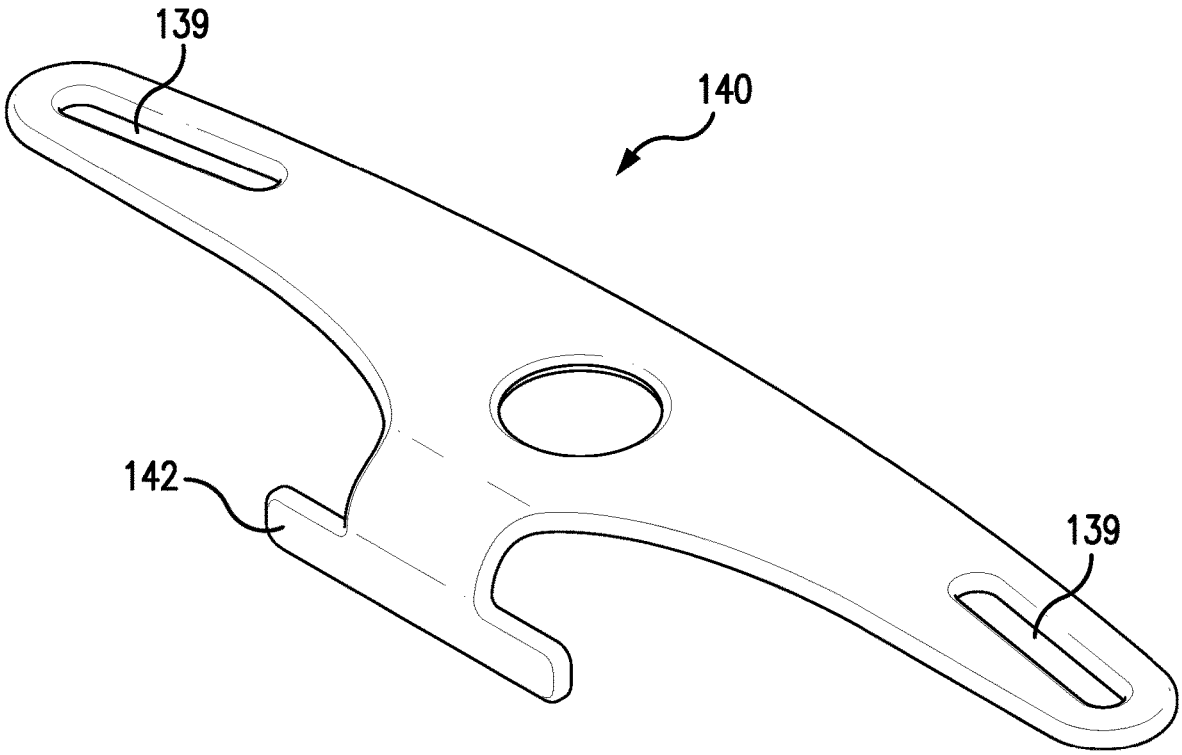
FIG. 27 is a perspective view of a hasp of the wheeled carrier shown in FIG. 1.
Figure 28:
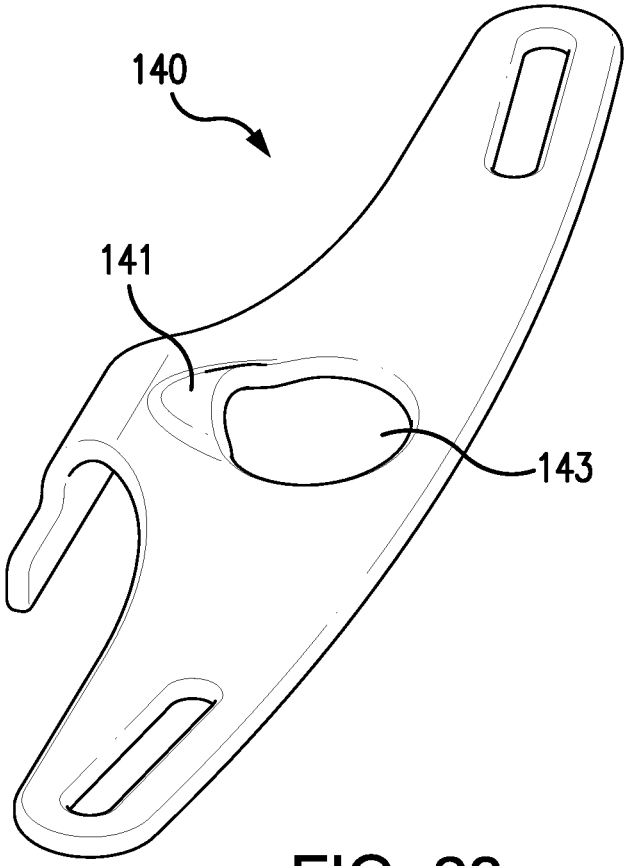
FIGS. 28-30 are perspective views of an alternate embodiment of the hasp shown in FIG. 27.
Figure 29:
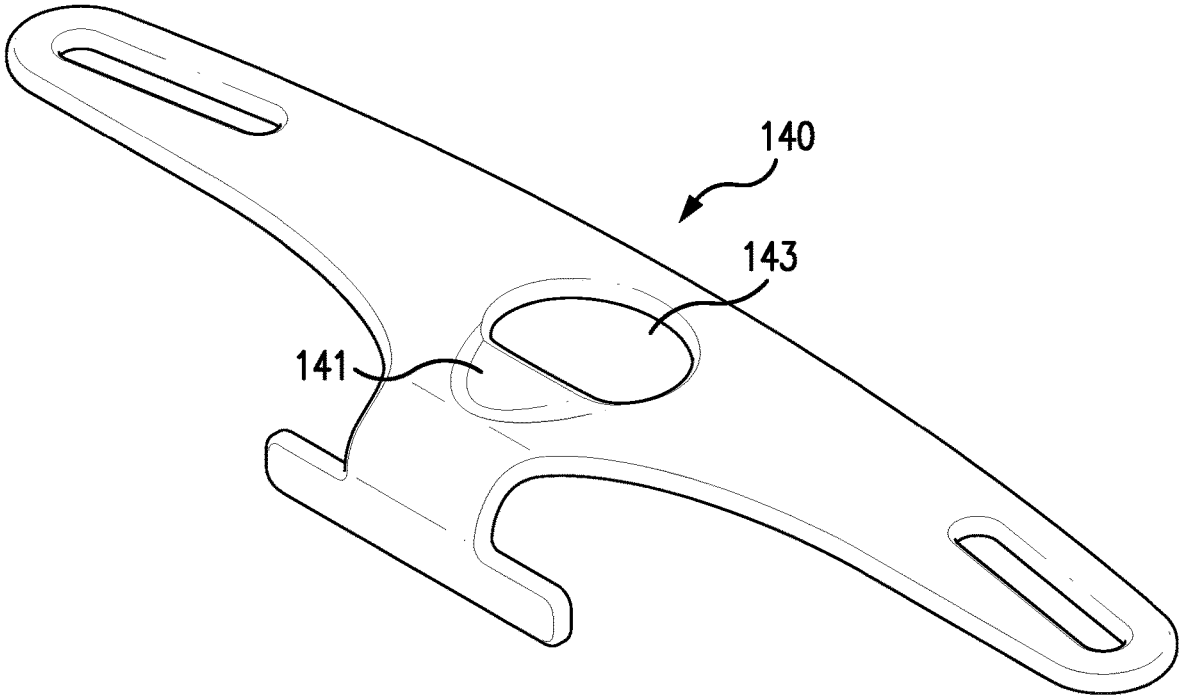
Figure 30:
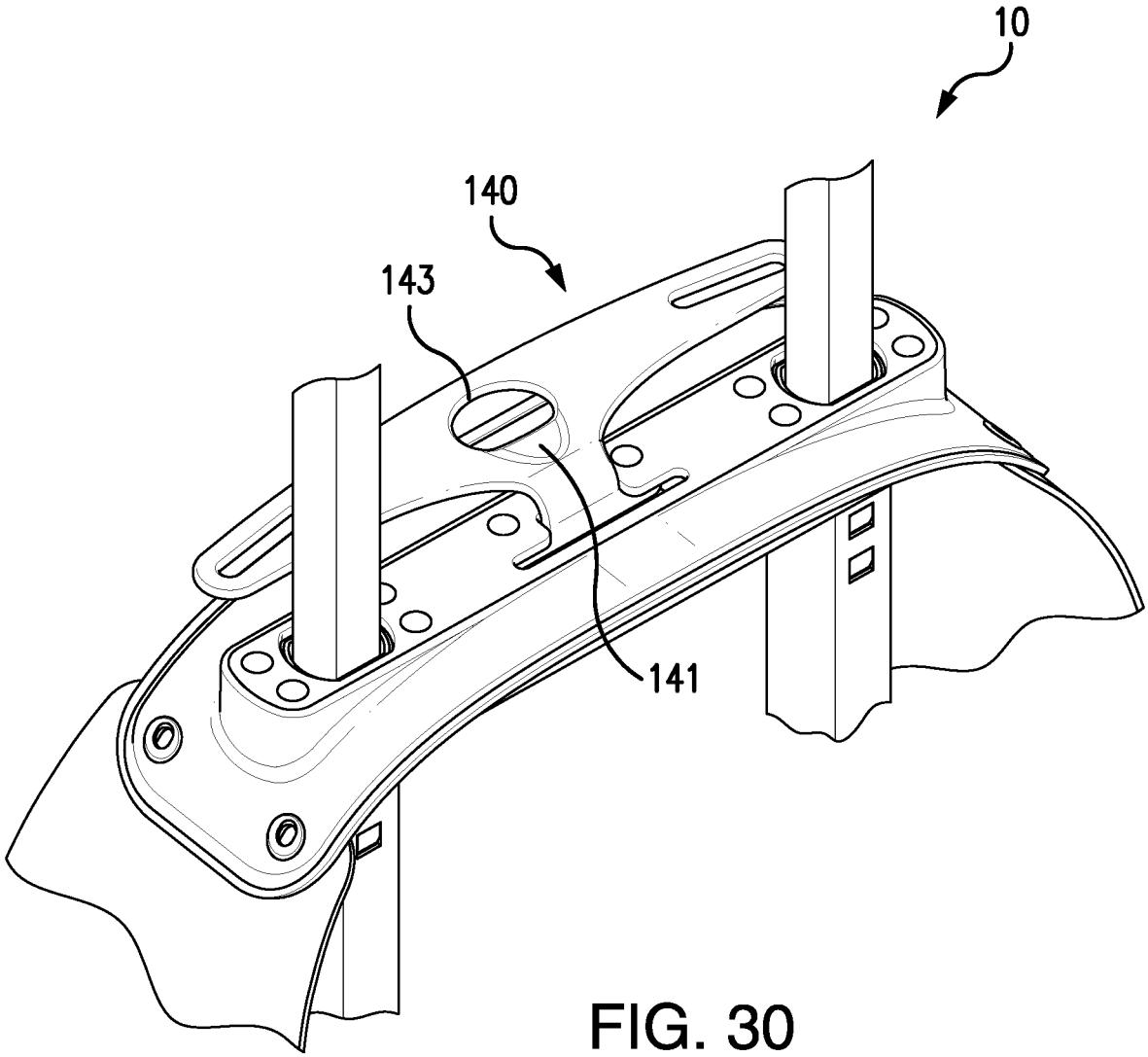
Figure 31:
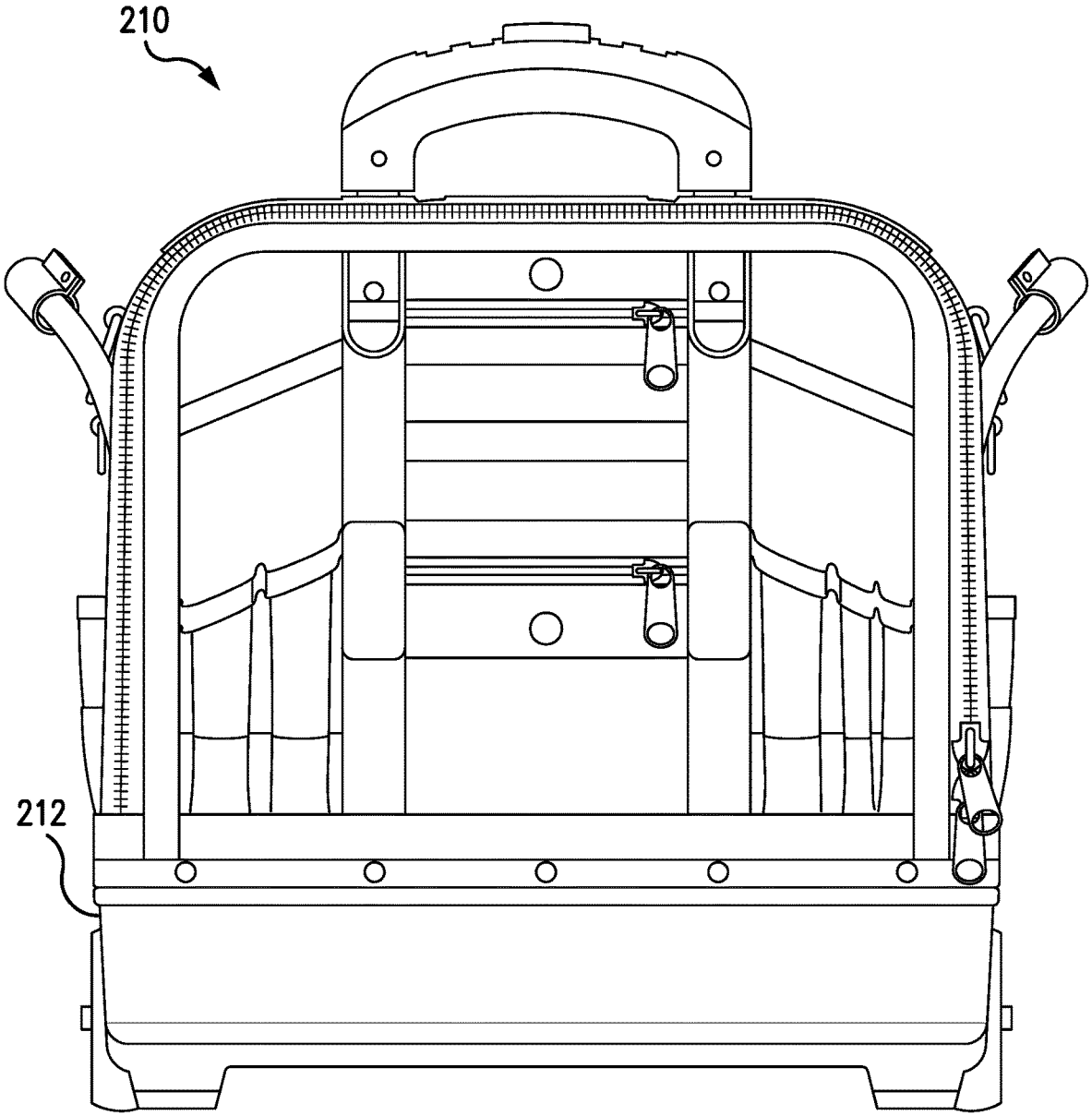
FIG. 31 is a front view of another embodiment of a wheeled carrier incorporating features of the present disclosure.
Figure 32:
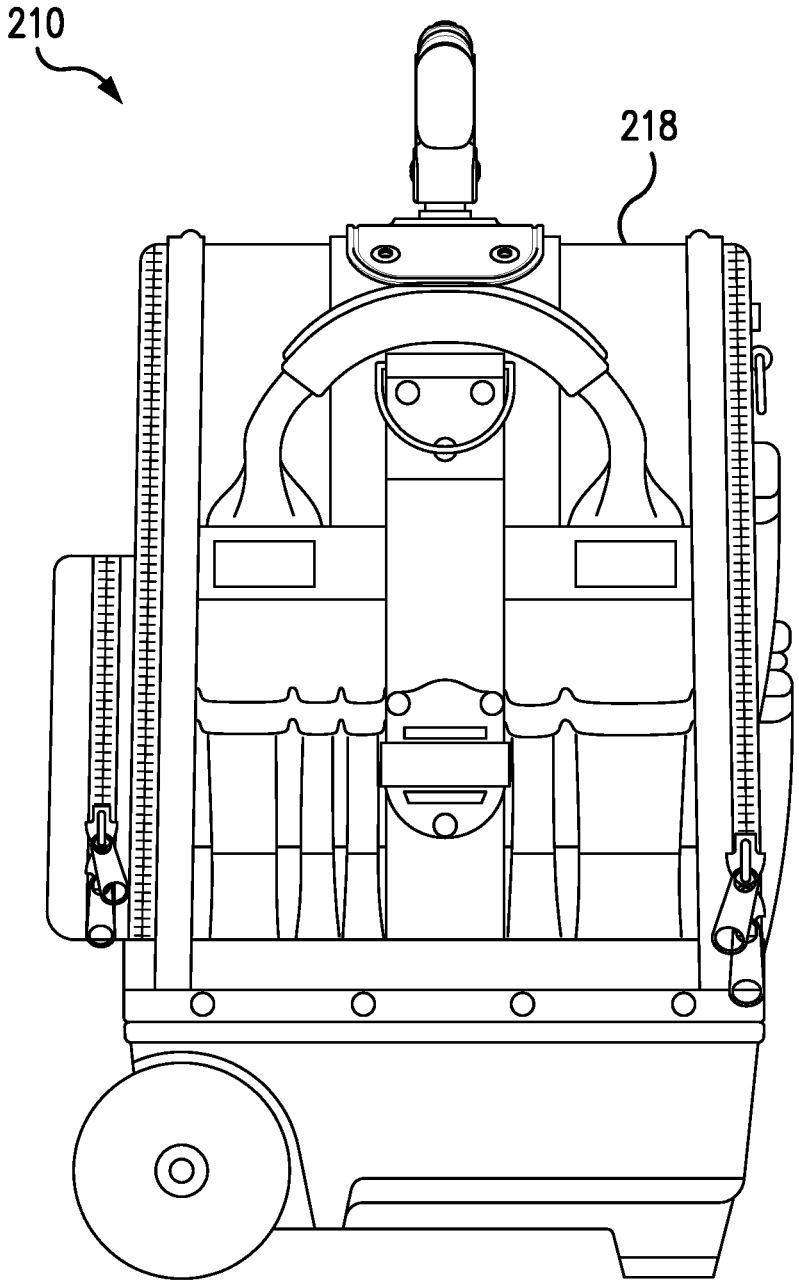
FIG. 32 is a right side view of the wheeled carrier shown in FIG. 31.
Figure 33:
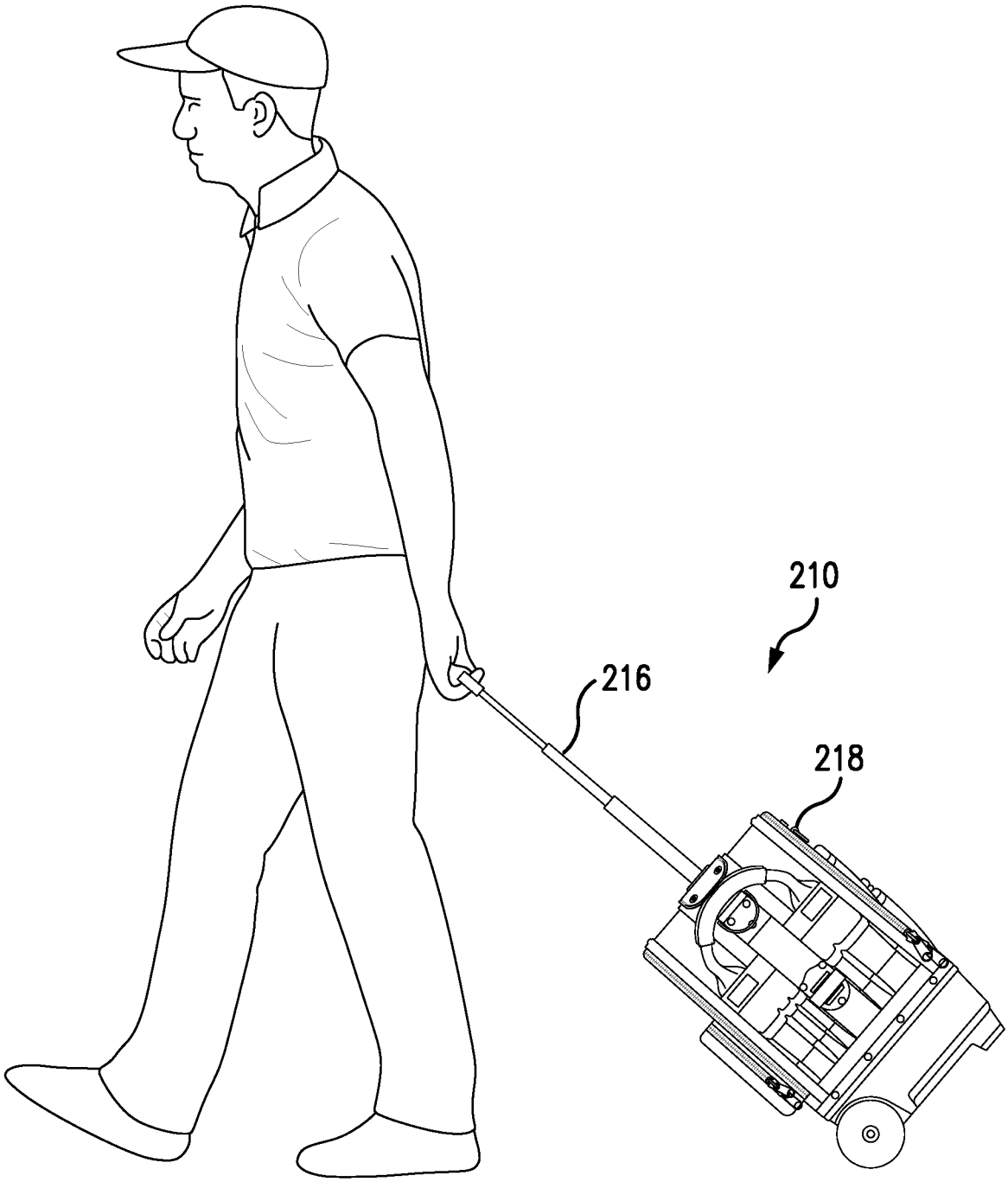
FIG. 33 is a perspective view of the wheeled carrier shown in FIG. 31 in use by a user.
Figure 34:
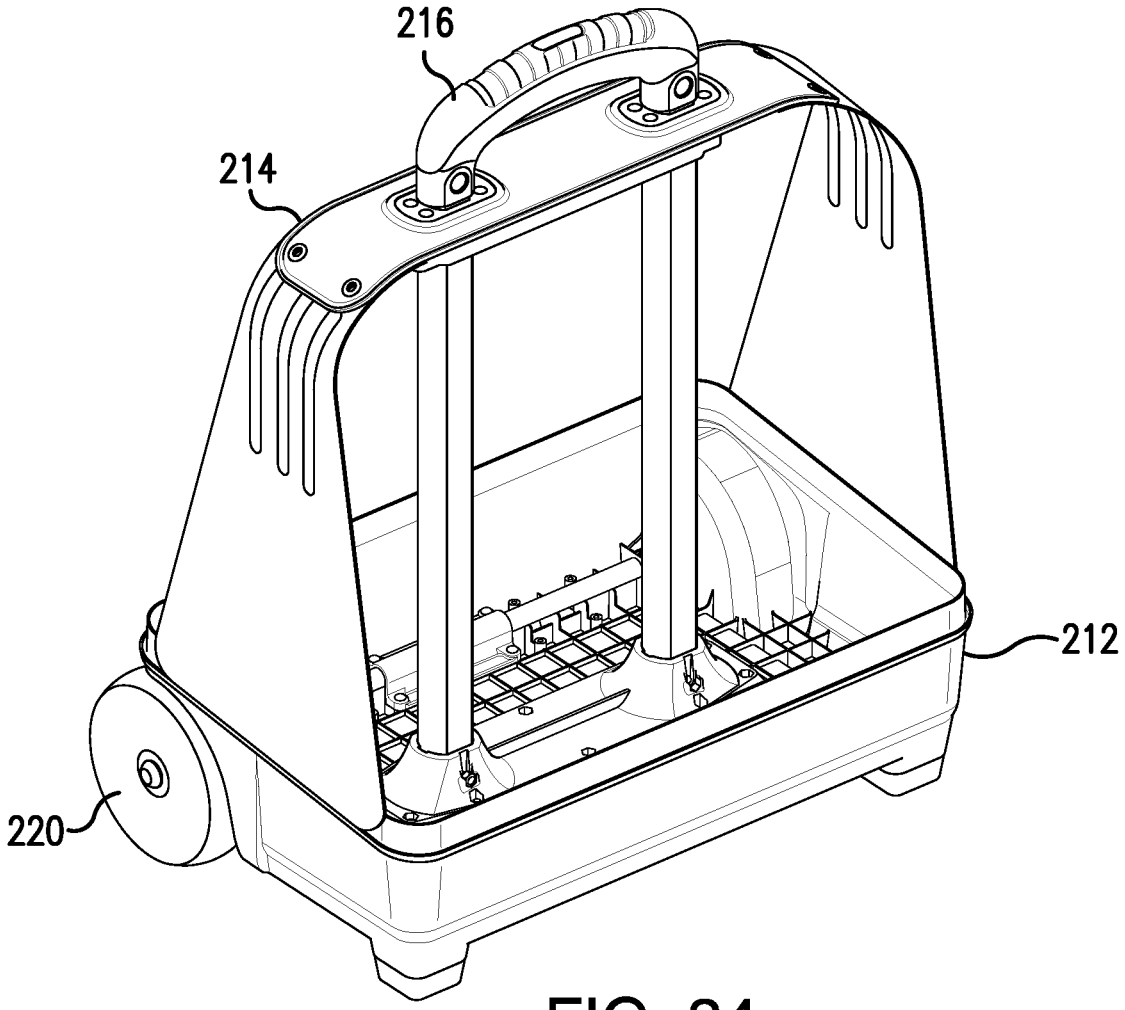
FIG. 34 is a perspective view of the wheeled carrier shown in FIG. 31 (illustrated without a fabric body) with a telescoping handle in a collapsed position.
Figure 35:
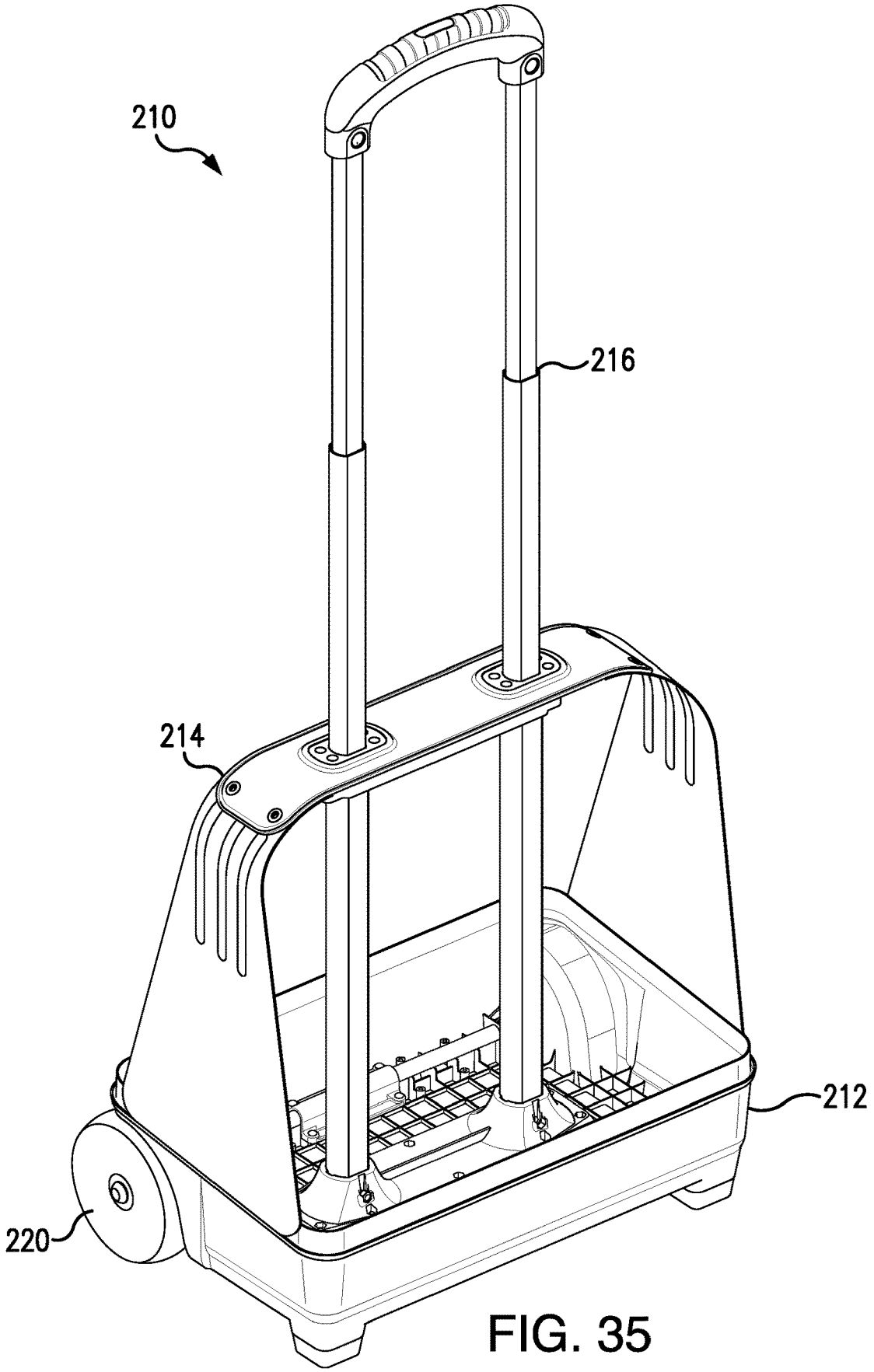
FIG. 35 is a perspective view of the wheeled carrier shown in FIG. 34 with the telescoping handle in an extended position.

With reference to FIGS. 2 and 4, a portion of the straps 130 extend through openings 139 of a metal hasp 140 which is configured to be connected to the yoke 24. The configuration of the backpack straps 130 and the hasp 140 help support the weight of the carrier 10 to remove the weight of the carrier from bearing on the fabric body or zippers, and instead carries the weight via the hasp 140, and the backpack straps 130. Additionally, the configuration of the backpack straps 130 and the hasp 140 permit the user to control the position of the carrier relative to the user's body. It will be noted by those familiar with the use of backpacks that it can be useful to allow a user to adjust the position of the backpack under different circumstances. For example, when walking on an inclined surface it may be useful to add length to the backpack straps 130 and allow the weight of the carrier to extend away from the user's body for balance. The hasp 140 (also shown in FIGS. 6 and 27) is releasable from the yoke 24 to provide for easier access to the rear compartment 90. According to various exemplary embodiments, the hasp 140 is configured to have a quick release connection between a connecting portion 142 of the hasp 140 (see FIG. 27) and a receiving portion 144 of the yoke 24 (see FIG. 7). However, in alternate embodiments any suitable connection between the hasp and yoke may be provided. Additionally, in some embodiments the hasp may further comprise a lip (or bump) 141 at a central opening 143 of the hasp 140 (see FIGS. 28-30). The lip (or bump) 141 provides an improved access area for a user's finger to manipulate the hasp 140 when attaching and/or removing the hasp 140 from the carrier 10.

While various exemplary embodiments have been described above in connection with a carrier that can be converted between a backpack mode and a rolling mode, one skilled in the art will appreciate that the various exemplary embodiments are not necessarily so limited and that alternate embodiments may comprise a carrier without a backpack mode. For example, a carrier without a backpack mode is shown in FIGS. 31-35. In this embodiment, the carrier 210 comprises a wheeled tool pack having a molded plastic base 212, a support assembly 214, a telescoping center handle assembly 216, a fabric body 218, and a pair of wheels 220 similar to the carrier 10. For example the configuration of the molded plastic base 212 is similar to the configuration of the molded plastic base 12, the configuration of the support assembly 214 is similar to the configuration of the support assembly 14, the configuration of the telescoping center handle assembly 216 is similar to the configuration of the telescoping center handle assembly 16, and the configuration of the fabric body 218 is similar to the configuration of the fabric body 18. However, in this embodiment, the carrier 210 does not include a padded back panel, backpack straps, or a hasp. Instead the fabric body 218 includes fabric pockets, zipper pockets, and/or D rings on front and back sides of the carrier 210. Although there may be some differences between the shapes of the molded plastic bases, the support assemblies, and the fabric bodies between the carriers 10, 210, the configuration of the centrally located handle assembly 216 relative to the base 212 and other disclosed features are substantially the same as the carrier 10 and one skilled in the art would understand that these differences do not depart from the spirit and the scope of the disclosed embodiments.

Figure 37:
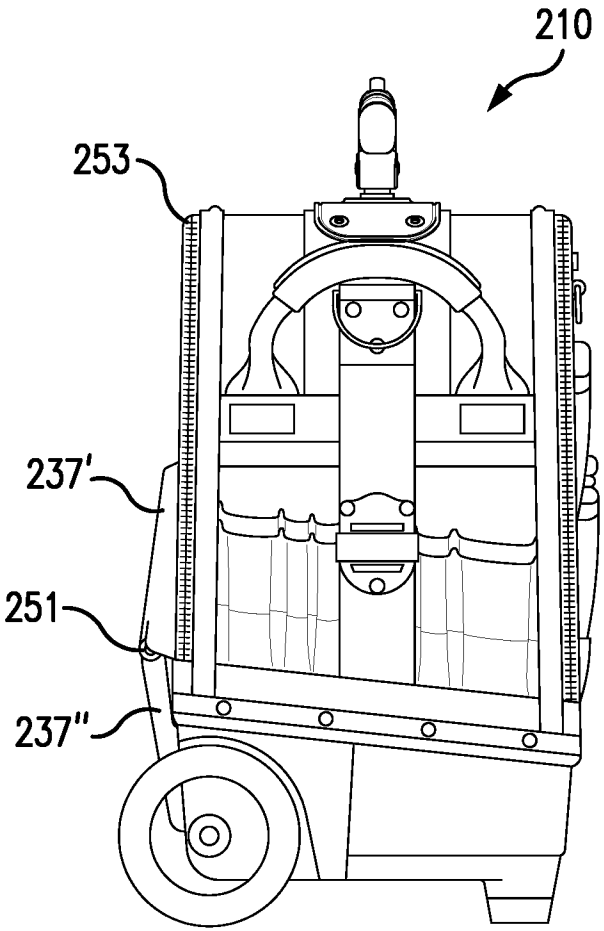
Figure 36:
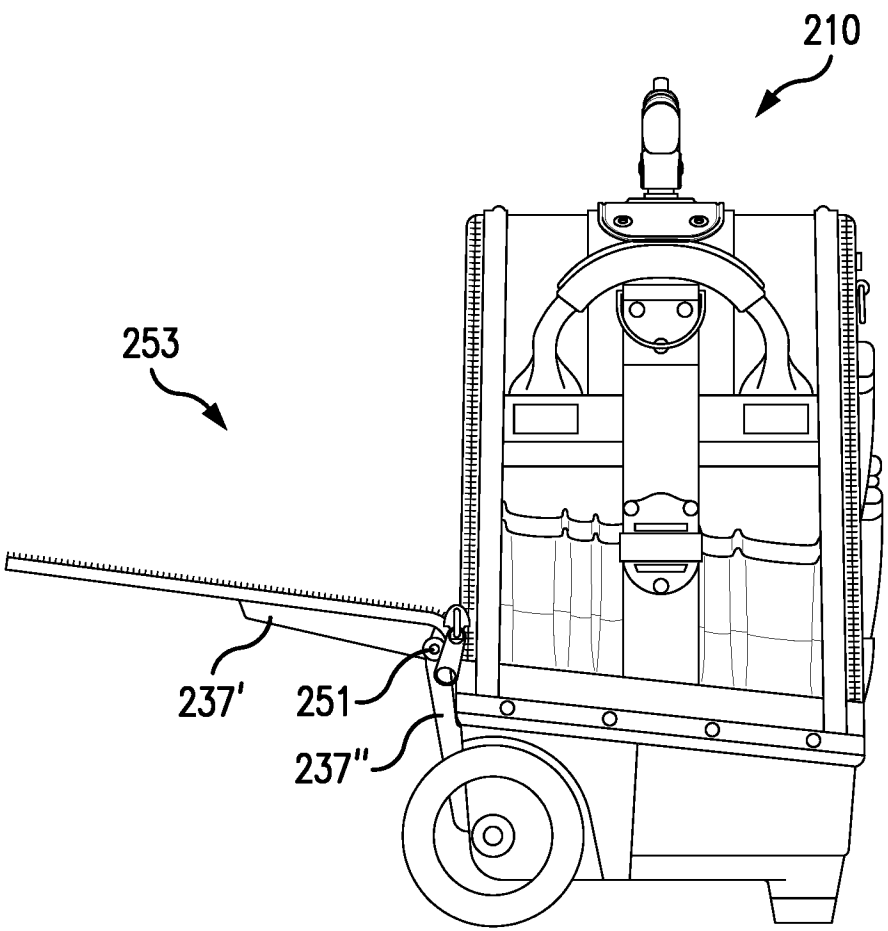
Figure 38:
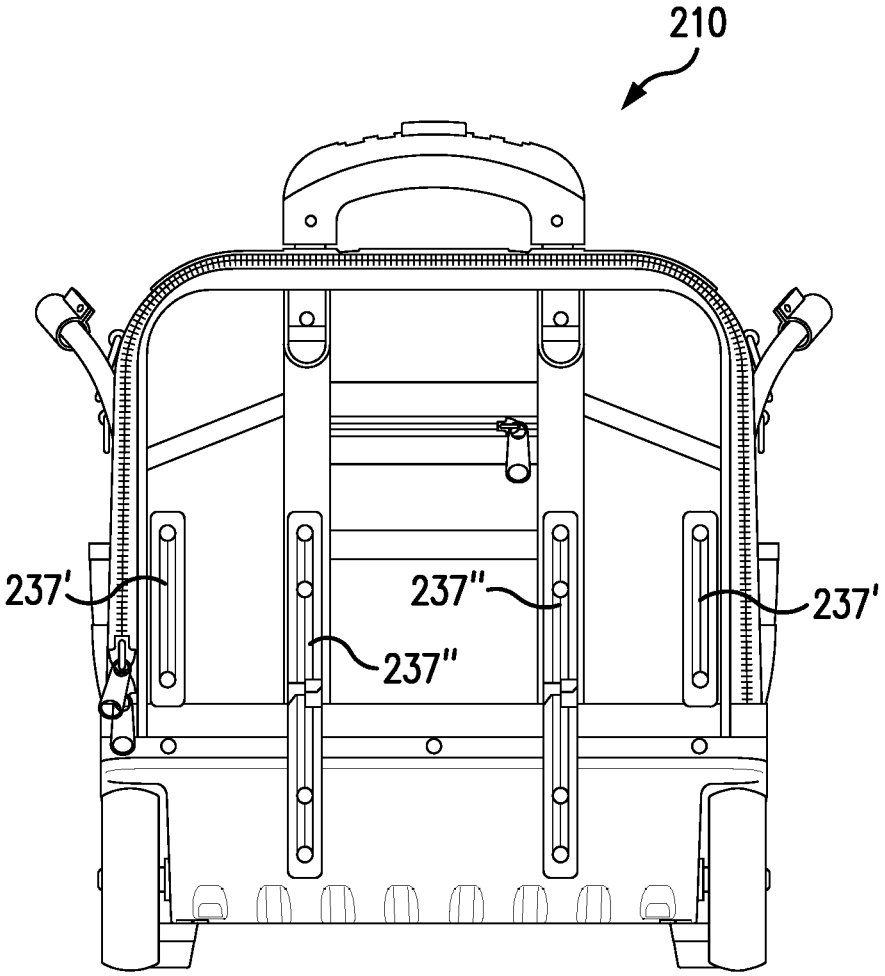
Figure 39:
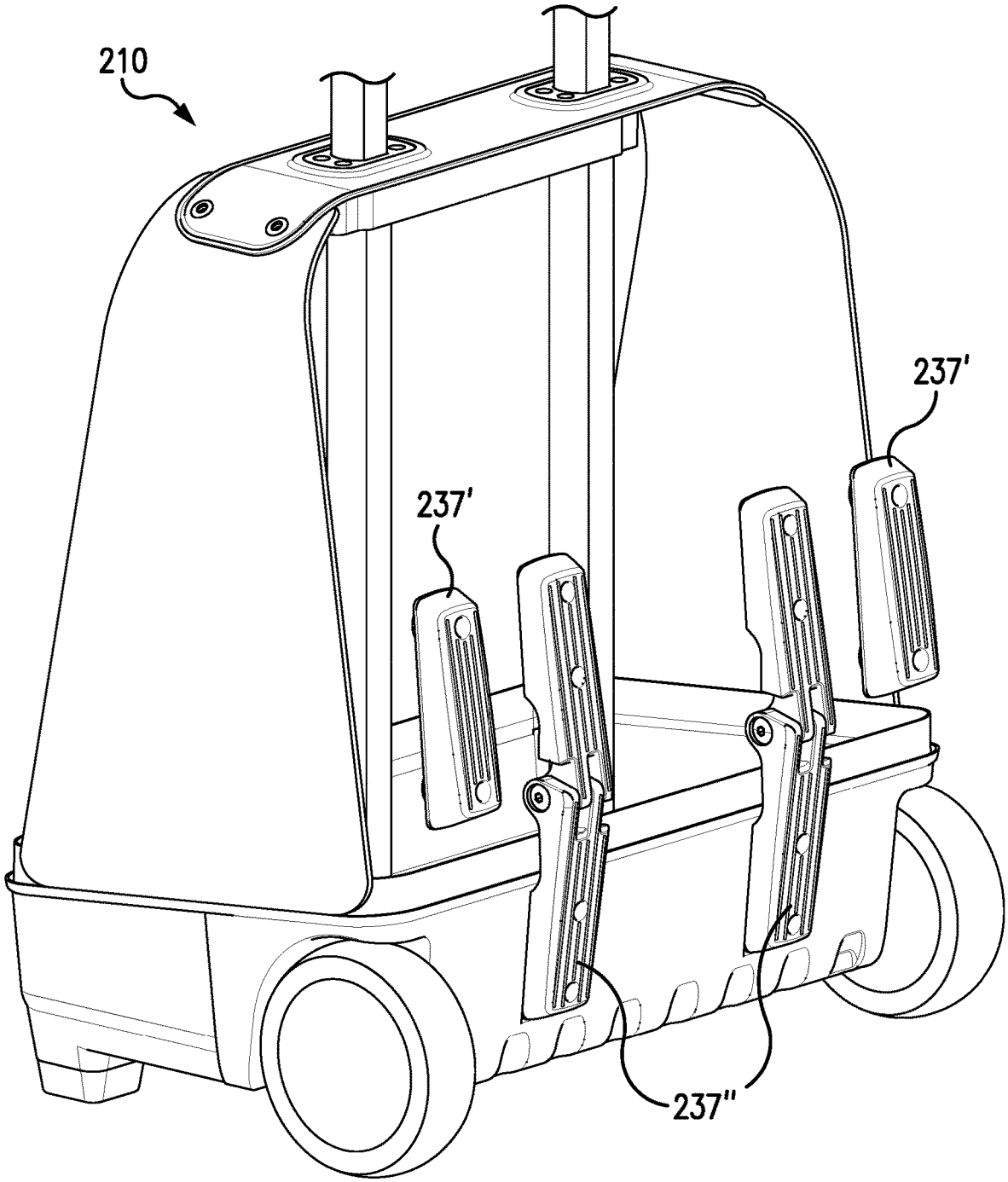
Figure 40:
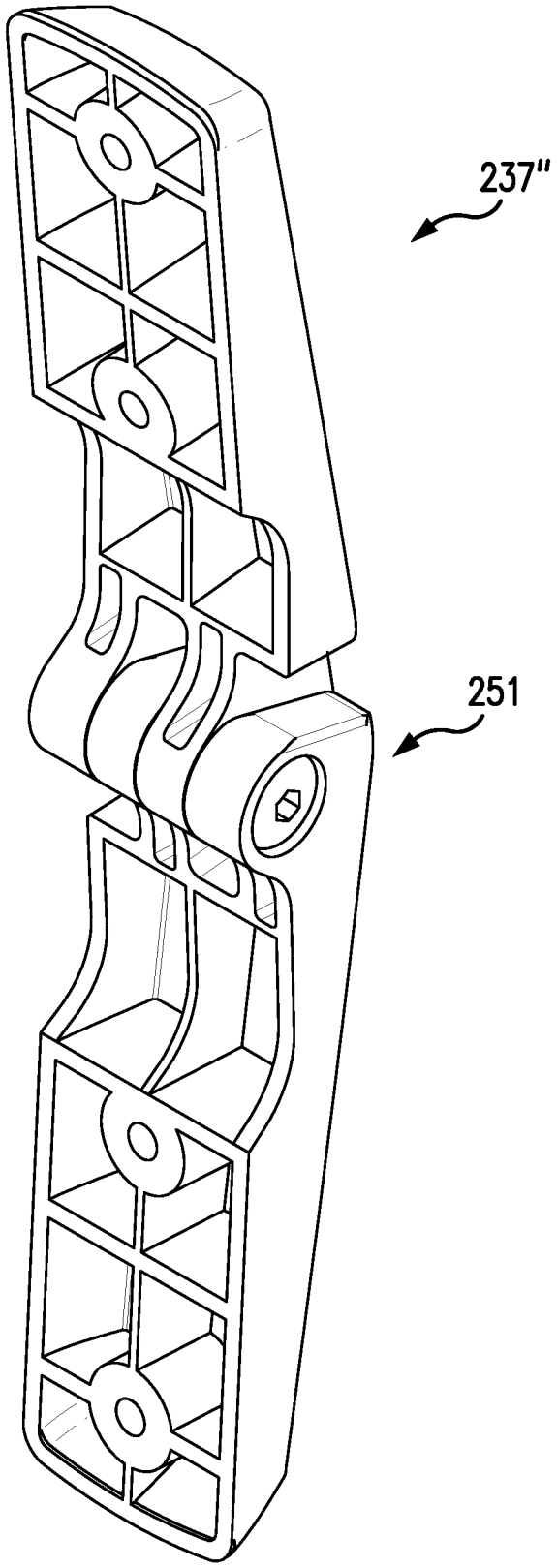
Figure 41:
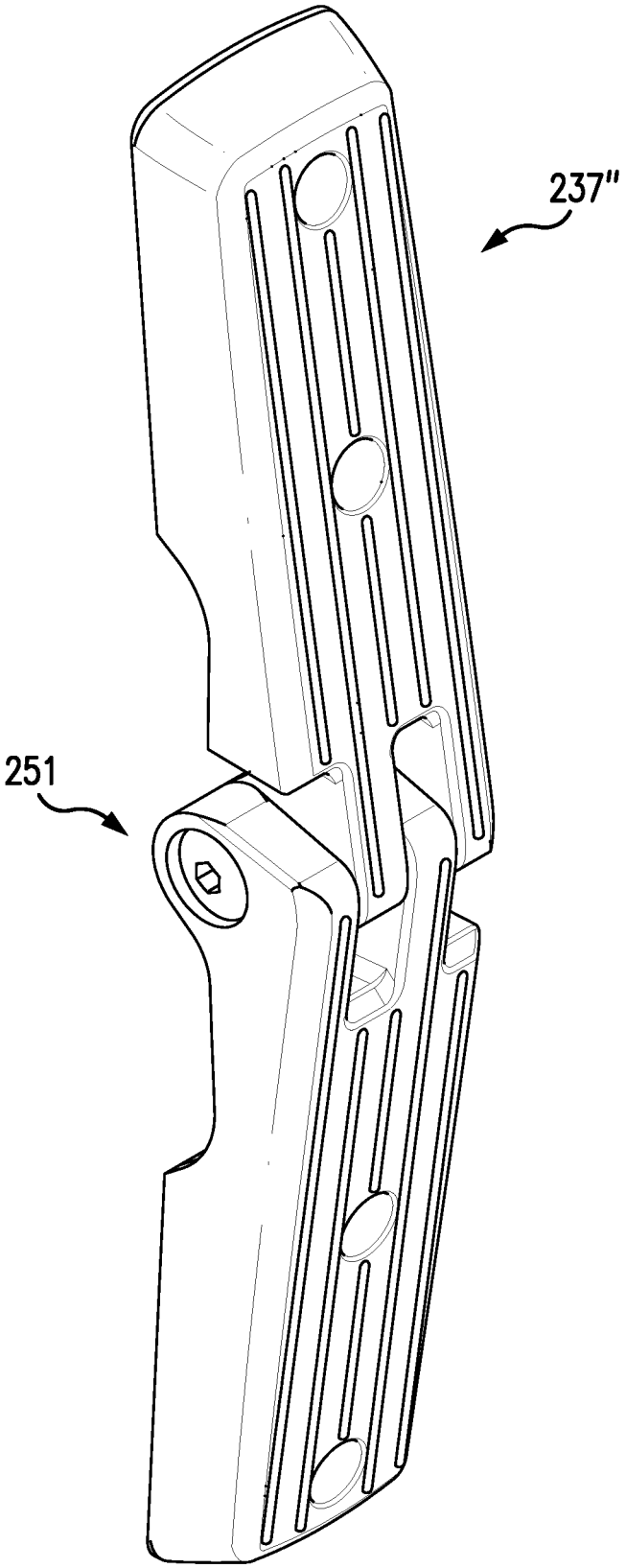

According to some embodiments the carrier 210 may further comprise molded rub rails 237', 237" (see FIGS. 35-39) on the back side of the carrier 210. The molded rub rails 237', 237" are configured to protect the carrier 210 when being dragged (instead of carried) up stairs and/or over tall curbs. The rub rails 237' may comprise a one piece member and are attached to the back side proximate lateral sides of the carrier 210. The rub rails 237" are attached to the back side between the rub rails 237' (however, in alternate embodiments and any suitable orientation of the rub rails 237', 237" may be provided). The rub rails 237" may comprise a two piece member having a hinging feature 251 therebetween (see FIG. 40, 41). The hinging feature 251 may comprise any suitable hinge configuration (such as a pin and corresponding openings, for example). The hinging feature 251 is configured such that a zippered pocket 253 (at the back side of the carrier 210) can still pivot open and allow full access to the vertical pockets inside (best seen in FIGS. 36, 37).

Figure 42:
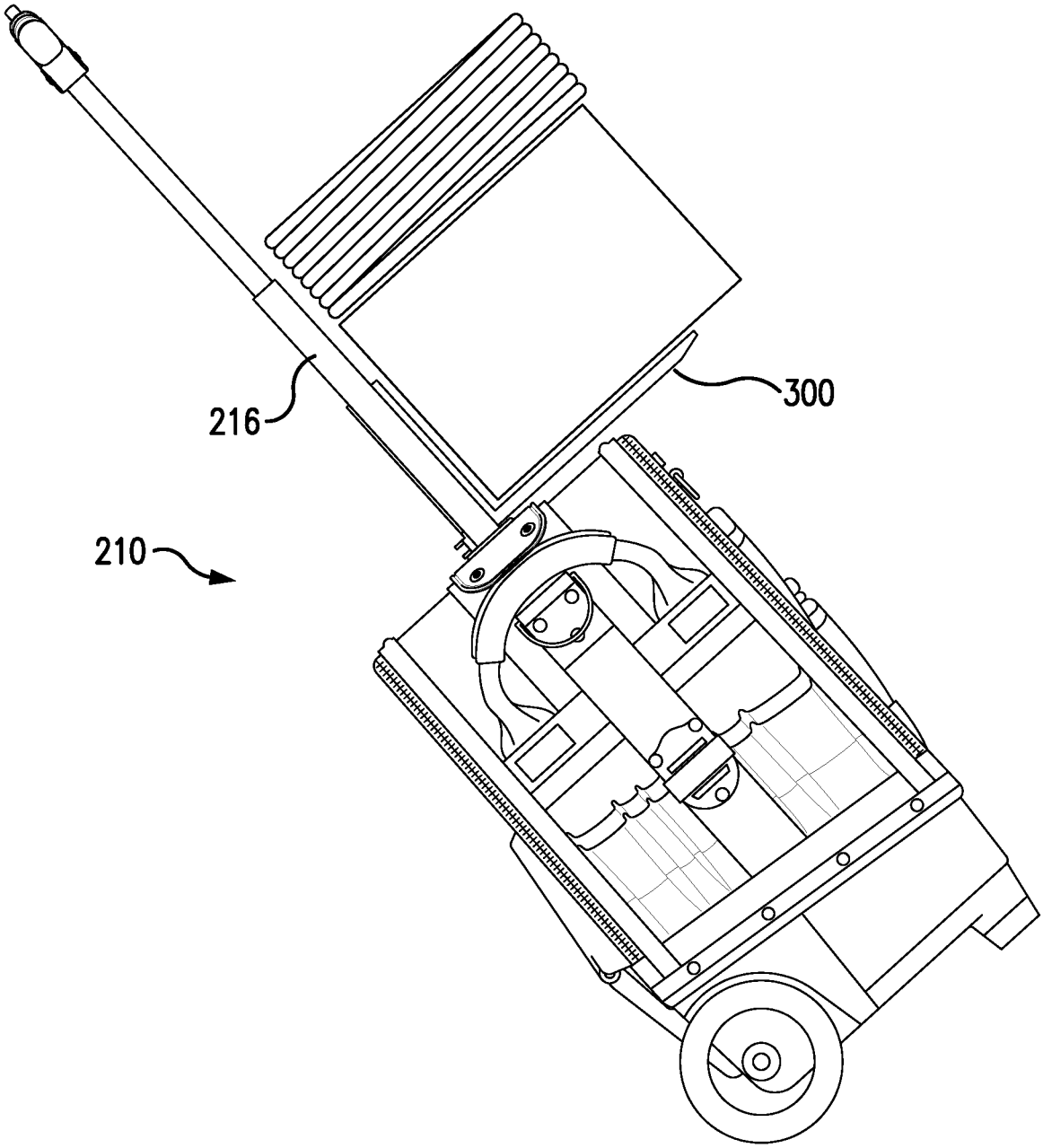
Figure 43:
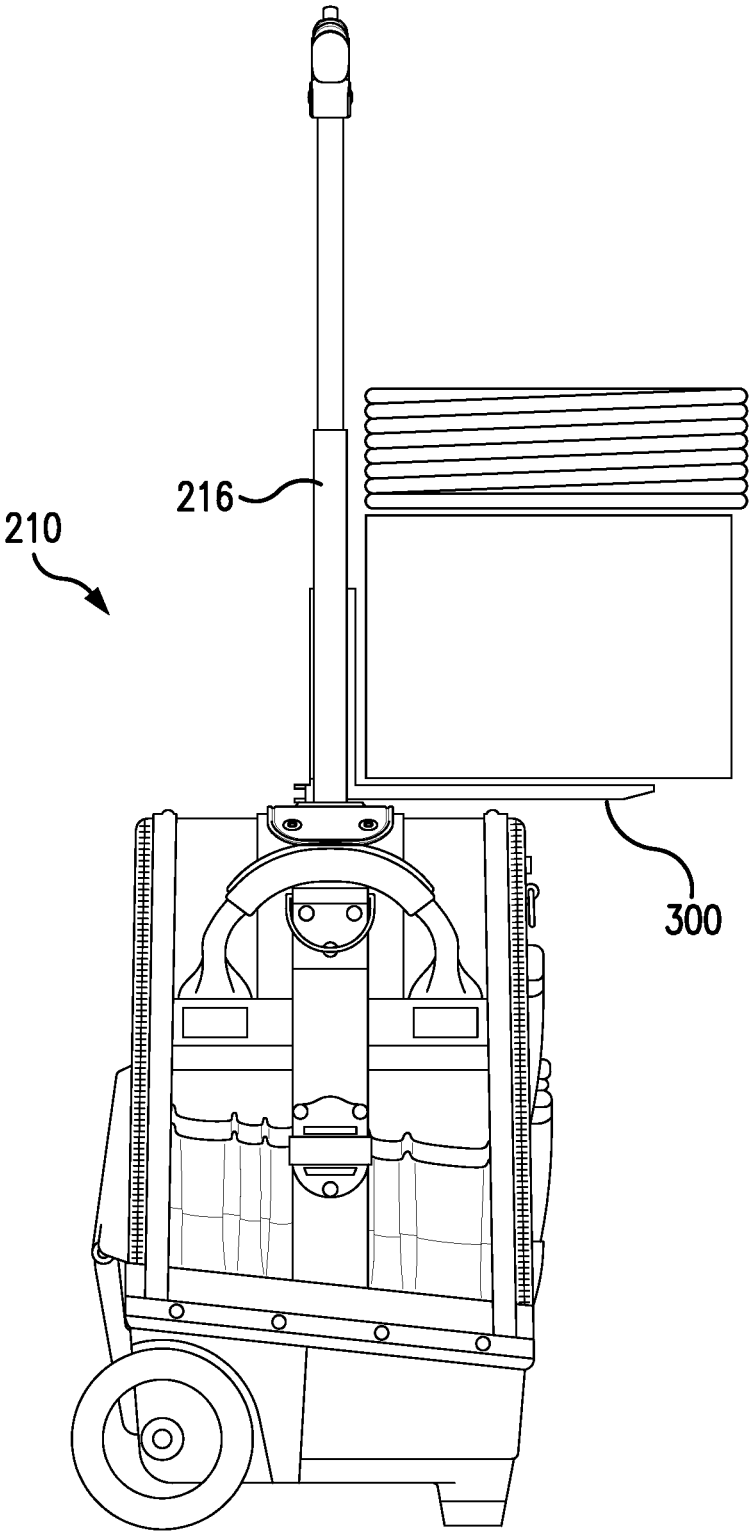
Figure 44:
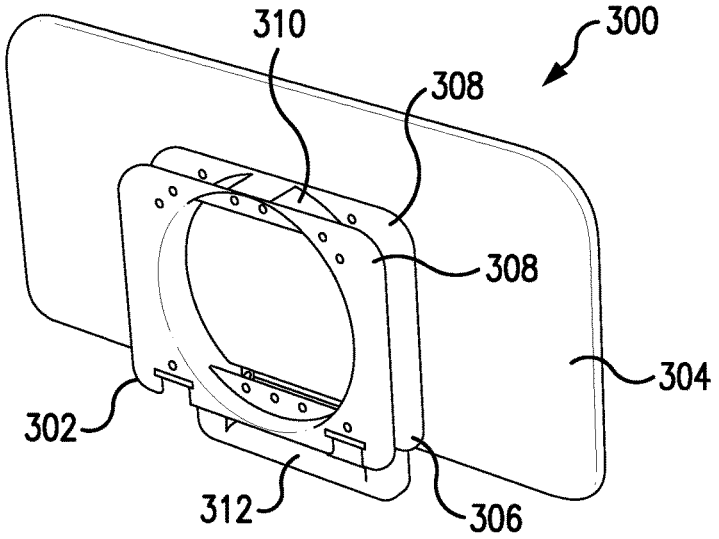
Figure 45:
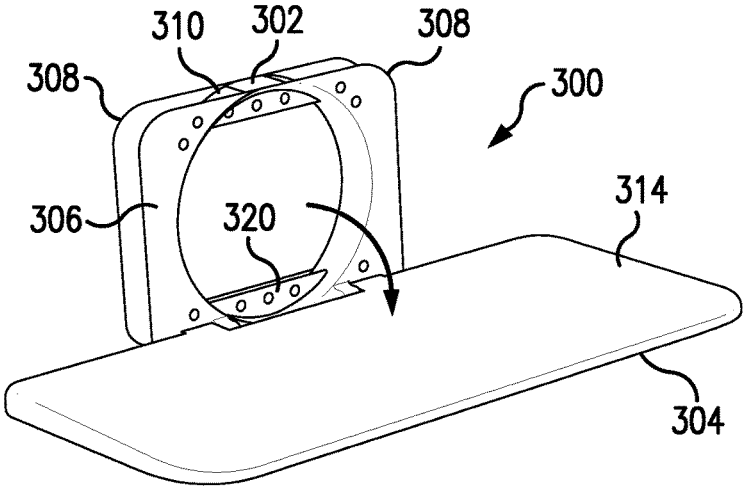
Figure 46:
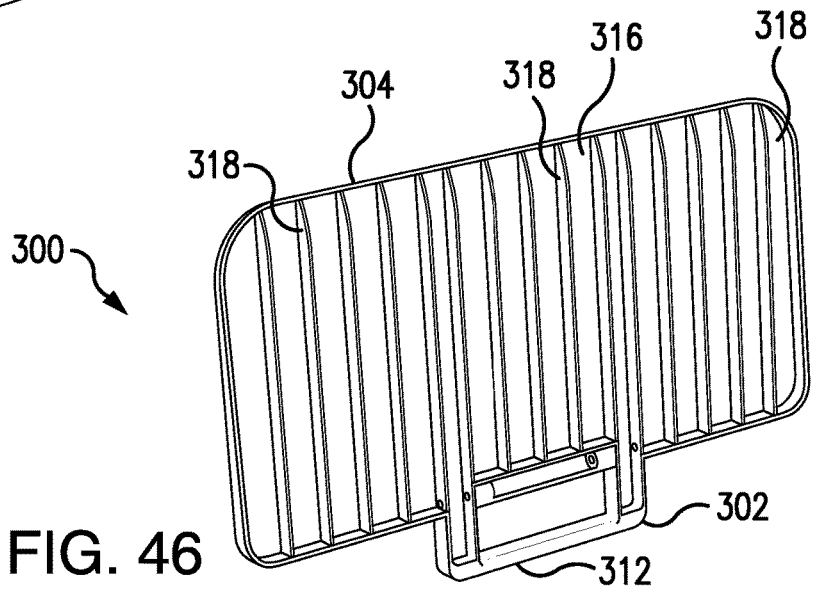

According to various exemplary embodiments, the location of the central handle 216 provides for an accessory attachment point. For example, and referring now also to FIGS. 42-47, a tie-down shelf 300 is shown. The tie-down shelf 300 is an optional accessory which could be used together with the carrier 210. The tie-down shelf 300 is configured to provide additional room to stack boxes or additional gear on the carrier 210, allowing the carrier 210 to function as a handtruck (see FIGS. 42-43). The optional tie-down shelf accessory 300 extends the top surface of the carrier providing more of a shelf for stacking and wheeling extra gear.

The tie-down shelf 300 comprises an attachment portion 302 and a platform portion 304. The attachment portion 302 comprises a generally rectangular shape with a groove section 306 between flanges 308 of the attachment portion 302. The groove section 306 further comprises a curved or contoured surface 310 at a base of the grooved section 306. According to some embodiments, the attachment portion 302 may further comprise a handle section 312 which can be used as a carrying handle prior to installation of the tie-down shelf accessory.

The platform portion 304 comprises a generally rectangular plate shape with a top side 314 having a substantially flat shape and a bottom side 316 having a plurality of stiffening ribs 318. However, it should be noted that any suitable configuration for the attachment portion and the platform portion may be provided.

The attachment portion 302 is foldable relative to the platform portion 304. For example in some embodiments, the folding configuration between the attachment portion 302 and the platform portion 304 may be provided with a hinge feature 320 (such as a pin and corresponding openings, for example), however in alternate embodiments, any suitable features allowing for a foldable configuration between the attachment portion 302 and the platform portion 304 may be provided.

Figure 47:
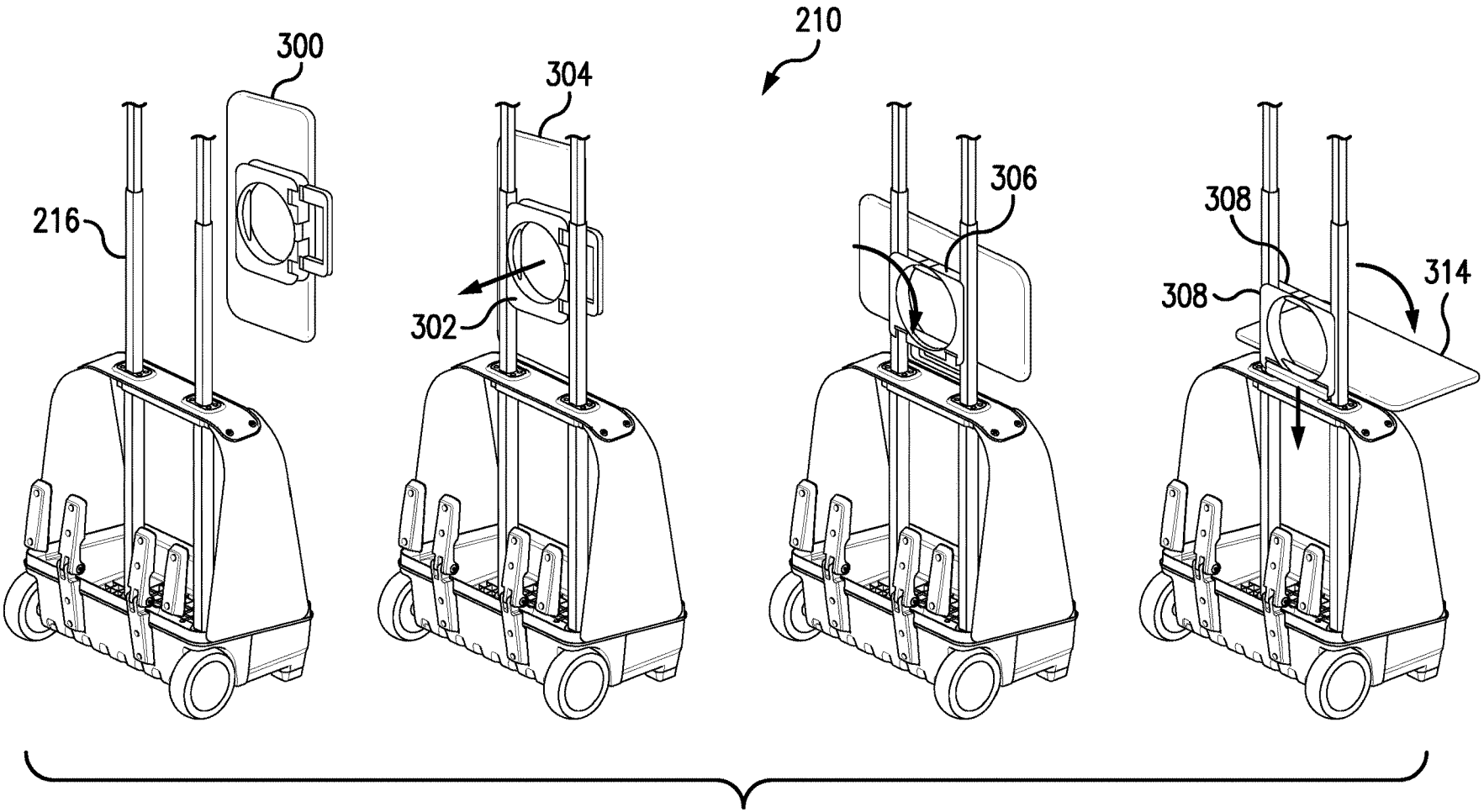

The tie-down shelf (or attachable platform shelf) 300 is configured such that narrower sides of the attachment portion are fitted between the legs of the center handle assembly 216 (see FIG. 47). Once narrower sides of the attachment portion 302 are fitted between the legs (or tubes) of the center handle assembly 216, the tie-down shelf 300 is rotated 90 degrees so that the legs of the center handle 216 assembly engage with the groove section 306 between the flanges 308 and the curved or contoured surface 310 at a base of the grooved section 306. As the platform portion 304 folds down, the tie-down shelf 300 secures itself to the telescoping tubes and cannot be removed until it is folded and rotated 90 degrees.

It should be noted that although the figures illustrate the tie-down shelf 300 installed on the wheeled carrier 210, the tie-down shelf 300 can also be used on the carrier 10 (or any other suitable carrier having a central handle or a non-central handle).

Many advantages according to the various exemplary embodiments are provided as the telescoping handle is configured to ergonomically aid a user in moving the wheeled carrier and divide the interior of the wheeled carrier. For example the wheeled carrier 10, 210 is configured such that the telescoping handle divides the interior of the wheeled carrier into two primary compartments having substantially the same size. This can provide for more even weight distribution between opposite sides of the telescoping handle when compared to conventional configurations.

With the removable/replaceable pocket sleeve panels and different pocket configurations customizable by the user, the primary compartments may vary in size but still account for a majority of storage space on opposite sides of the telescoping handle. For example, the wheeled carrier comprises an overall depth dimension ("D") between the first end and the second end (see FIGS. 2, 28), wherein the telescoping handle is configured to divide the interior of the wheeled carrier into two primary compartments. For example, as seen in FIG. 15, in some embodiments each compartment 88, 90 can have a depth dimension 89, 91 of at least one fourth of the overall depth dimension. In other embodiments, each compartment 88, 90 can have a depth dimension 89, 91 of at least one third of the overall depth dimension. In yet other embodiments, each compartment 88, 90 can have a depth dimension 89, 91 of approximately one half of the overall depth dimension. However in alternate embodiments any suitable sizing (including different sizing for each primary compartment) for the primary compartments may be provided.

Below are provided further descriptions of various non-limiting, exemplary embodiments. The below-described exemplary embodiments may be practiced in conjunction with one or more other aspects or exemplary embodiments. That is, the exemplary embodiments of the invention, such as those described immediately below, may be implemented, practiced or utilized in any combination (e.g., any combination that is suitable, practicable and/or feasible) and are not limited only to those combinations described herein and/or included in the appended claims.

In one exemplary embodiment, a wheeled carrier is disclosed. The wheeled carrier comprises: a base having a bottom surface, opposing first and second ends and opposing first and second lateral sides between the first and second ends; a body extending upward from the base, said body defining an interior; a pair of wheels connected to the base, wherein the pair of wheels are configured to rotate about a central axis, and wherein the central axis is proximate the second end; a support extending from the first and second lateral sides of the base to an apex, said apex of the support defining an opening; and a telescoping handle projecting from a center of the bottom surface of the base, said telescoping handle projecting through the opening defined by the apex, wherein the telescoping handle is configured to ergonomically aid a user in moving the wheeled carrier and divide the interior of the wheeled carrier.

A wheeled carrier as above, wherein the telescoping handle is configured to divide the interior of the wheeled carrier into a first primary compartment and a second primary compartment.

A wheeled carrier as above, wherein the first primary compartment and the second primary compartment are substantially the same size.

A wheeled carrier as above, wherein the wheeled carrier comprises an overall depth dimension between the first end and the second end, wherein the telescoping handle is configured to divide the interior of the wheeled carrier into two primary compartments each having a depth dimension of at least one third of the overall depth dimension.

A wheeled carrier as above, wherein the wheeled carrier comprises an overall height dimension between a contact surface of the wheels and the apex, and an overall width dimension between the first and second lateral sides of the base.

A wheeled carrier as above, wherein the telescoping handle is secured to the base by a mounting plate, wherein the mounting plate is substantially centered relative to the bottom surface of the base between the first and second ends of the base.

A wheeled carrier as above, wherein the telescoping handle is spaced from the central axis.

A wheeled carrier as above, wherein the support is comprised of a yoke and at least one structural panel extending upward from the base.

A wheeled carrier as above, further comprising a hasp and a pair of backpack straps, wherein the hasp is connected to the support, and the pair of backpack straps are connected to the hasp.

In another exemplary embodiment, a wheeled carrier comprising: a base having a bottom surface, opposing first and second ends and opposing first and second lateral sides between the first and second ends; a pair of wheels connected to the base, wherein the pair of wheels are configured to rotate about a central axis; and a telescoping handle extending from the bottom surface of the base, wherein the telescoping handle extends along a plane substantially perpendicular to the base; wherein the plane is between the first end of the base and the central axis, wherein the central axis is spaced from the first end of the base and proximate the second end of the base, and wherein the central axis is between the second end of the base and the plane.

A wheeled carrier as above, further comprising a pair of front feet connected to the base, wherein the telescoping handle is between the pair of front feet and the central axis.

A wheeled carrier as above, further comprising a pair of front feet and a mounting plate, wherein the pair of front feet are connected to the base, wherein the mounting plate is between the pair of front feet and the central axis, and wherein the telescoping handle is secured to the base by the mounting plate.

A wheeled carrier as above, further comprising a pair of backpack straps, wherein the backpack straps are configured to be stowed in a compartment of the wheeled carrier.

A wheeled carrier as above, further comprising a support extending from the first and second lateral sides of the base to an apex, said apex of the support defining an opening.

A wheeled carrier as above, wherein the telescoping handle is configured to project through the opening defined by the apex.

In another exemplary embodiment, a wheeled carrier comprising: a base having a bottom surface, opposing first and second ends and opposing first and second lateral sides between the first and second ends, and wherein the wheeled carrier comprises an overall depth dimension between the first and second ends; a body extending upward from the base, said body defining an interior; a pair of wheels connected to the base, wherein the pair of wheels are configured to rotate about a central axis; a telescoping handle extending from the bottom surface of the base, wherein the telescoping handle extends along a plane substantially perpendicular to the base; wherein the plane is between two compartments of the interior, and wherein each one of the two compartments has a depth dimension of at least one third of the overall depth dimension.

A wheeled carrier as above, wherein the wheeled carrier comprises an overall height dimension between a contact surface of the wheels and a top of the body opposite the base, and an overall width dimension between the first and second lateral sides of the base.

A wheeled carrier as above, further comprising replaceable pocket sleeve panels on opposite sides of the telescoping handle.

A wheeled carrier as above, wherein one of the replaceable pocket sleeve panels comprises a substantially flat configuration, and wherein another one of the replaceable pocket sleeve panels comprises grooves configured to surround stationary portions of the telescoping handle.

A wheeled carrier as above, further comprising a pair of front feet connected to the base, wherein the telescoping handle is substantially centered between the pair of front feet and the central axis.

A wheeled carrier as above, further comprising an attachable platform shelf, wherein the attachable platform shelf comprises an attachment portion and a platform portion, wherein the attachment portion is configured to be removably attached to the telescoping handle, and wherein the platform portion is configured to extend perpendicularly from the telescoping handle.

It should be understood that components of the invention can be operationally coupled or connected and that any number or combination of intervening elements can exist (including no intervening elements). The connections can be direct or indirect and additionally there can merely be a functional relationship between components.

It should be understood that the foregoing description is only illustrative of the various exemplary embodiments. Many advantages of the disclosed carrier will now be apparent to those skilled in the art. Many choices of materials, components, attachment means and fasteners may be made without departing from the scope of the disclosure. Additionally, various alternatives and modifications can be devised by those skilled in the art without departing from the disclosure. Accordingly the disclosed embodiment(s) is to be construed as illustrative only and not limiting, and the disclosure is intended to embrace all such alternatives, modifications and variances which fall within the scope of the appended claims.

The invention claimed is:

1. A wheeled carrier comprising:

a base having a bottom surface, opposing first and second ends and opposing first and second lateral sides between the first and second ends;

a body extending upward from the base, said body defining an interior;

a pair of wheels connected to the base, wherein the pair of wheels are configured to rotate about an axis, and wherein the axis is proximate the second end;

a support extending from the first and second lateral sides of the base to an apex, said apex of the support defining an opening; and a telescoping handle assembly projecting from a center of the bottom surface of the base, said telescoping handle assembly projecting through the opening defined by the apex with a handle portion configured to ergonomically aid a user in moving the wheeled carrier, wherein the telescoping handle assembly is configured to at least partially divide the interior of the wheeled carrier;

wherein the telescoping handle assembly includes the handle portion exterior to the body and two legs extending from the base to the handle portion, the two legs positioned inboard from each of the first and second lateral sides;

wherein the wheeled carrier further comprises replaceable pocket sleeve panels on opposite sides of the two legs between the base and the apex of the support.

2. The wheeled carrier of claim 1, wherein the telescoping handle assembly is configured to divide the interior of the wheeled carrier into a first primary compartment and a second primary compartment.

3. The wheeled carrier of claim 2, wherein the first primary compartment and the second primary compartment are substantially a same size.

4. The wheeled carrier of claim 1, wherein the wheeled carrier comprises an overall depth dimension between the first end and the second end, wherein the telescoping handle assembly is configured to divide the interior of the wheeled carrier into two primary compartments each having a depth dimension of at least one third of the overall depth dimension.

5. The wheeled carrier of claim 1, wherein the telescoping handle assembly is secured to the base by a mounting plate, wherein the mounting plate is substantially centered relative to the bottom surface of the base between the first and second ends of the base.

6. The wheeled carrier of claim 1, wherein the telescoping handle assembly is spaced from the axis.

7. The wheeled carrier of claim 1, wherein the support is comprised of a yoke and at least one structural panel extending upward from the base.

8. The wheeled carrier of claim 1, further comprising a hasp and a pair of backpack straps, wherein the hasp is connected to the support, and the pair of backpack straps are connected to the hasp.

9. The wheeled carrier of claim 1, wherein one of the replaceable pocket sleeve panels comprises grooves configured to at least partially surround the two legs of the telescoping handle assembly.

10. A wheeled carrier comprising:

a base having a bottom surface, opposing first and second ends and opposing first and second lateral sides between the first and second ends;

a pair of wheels connected to the base, wherein the pair of wheels are configured to rotate about an axis; and a telescoping handle assembly extending from the bottom surface of the base, wherein the telescoping handle assembly extends along a plane substantially perpendicular to the base;

removable panels on opposite sides of the telescoping handle assembly; and wherein the plane is between the first end of the base and the axis, wherein the axis is spaced from the first end of the base and proximate the second end of the base, and wherein the axis is between the second end of the base and the plane.

11. The wheeled carrier of claim 10, further comprising a pair of front feet connected to the base, wherein the telescoping handle assembly is between the pair of front feet and the axis.

12. The wheeled carrier of claim 10, further comprising a pair of front feet and a mounting plate, wherein the pair of front feet are connected to the base, wherein the mounting plate is between the pair of front feet and the axis, and wherein the telescoping handle assembly is secured to the base by the mounting plate.

13. The wheeled carrier of claim 10, further comprising a pair of backpack straps, wherein the backpack straps are configured to be stowed in a compartment of the wheeled carrier.

14. The wheeled carrier of claim 10, further comprising a support extending from the first and second lateral sides of the base to an apex, said apex of the support defining an opening.

15. The wheeled carrier of claim 14, wherein the telescoping handle assembly is configured to project through the opening defined by the apex.

16. A wheeled carrier comprising:

a base having a bottom surface, opposing first and second ends and opposing first and second lateral sides between the first and second ends, and wherein the wheeled carrier comprises an overall depth dimension between the first and second ends;

a body extending upward from the base, said body defining an interior;

a pair of wheels connected to the base;

a telescoping handle assembly extending from the bottom surface of the base inboard of each of the first and second lateral sides, wherein the telescoping handle assembly extends along a plane substantially perpendicular to the base; and replaceable pocket sleeve panels on opposite sides of the telescoping handle assembly;

wherein the plane is between two compartments of the interior, and wherein each one of the two compartments has a depth dimension of at least one third of the overall depth dimension.

17. The wheeled carrier of claim 16, wherein one of the replaceable pocket sleeve panels comprises a substantially flat configuration, and wherein another one of the replaceable pocket sleeve panels comprises grooves configured to surround stationary portions of the telescoping handle assembly.

18. The wheeled carrier of claim 16, further comprising a pair of front feet connected to the base, wherein the telescoping handle assembly is substantially centered between the pair of front feet and the pair of wheels.

19. The wheeled carrier of claim 10, wherein at least one of the removeable panels includes at least one pocket, enclosure, or attachment ring.

20. The wheeled carrier of claim 10, wherein at least one of the removeable panels includes a pocket or an enclosure that is removably arranged on the at least one of the removeable panels with fasteners.

21. A wheeled carrier comprising:

a base having a bottom surface, opposing first and second ends and opposing first and second lateral sides between the first and second ends, and wherein the wheeled carrier comprises an overall depth dimension between the first and second ends;

a body extending upward from the base, said body defining an interior;

a pair of wheels connected to the base; and a telescoping handle assembly extending from the bottom surface of the base inboard of each of the first and second lateral sides, wherein the telescoping handle assembly extends along a plane substantially perpendicular to the base;

wherein the telescoping handle assembly includes a handle portion exterior to the body and two legs extending from the base to the handle portion, the two legs positioned inboard from each of the first and second lateral sides;

wherein the plane is between two compartments of the interior, and wherein each one of the two compartments has a depth dimension of at least one third of the overall depth dimension;

the wheeled carrier further comprising an attachable platform shelf including an attachment portion having flanges defining a channel with two grooved section opposite one another for engaging the two legs, a platform portion, and a hinge between the attachment portion and the platform portion, wherein the attachable platform is configured to be removably attached to the telescoping handle assembly by the attachment portion engaging laterally between the two legs with each of the two grooved sections engaged against a respective one of the two legs, and wherein the platform portion is configured to rotate about the hinge between a stowed position adjacent to the telescoping handle assembly and an extended position perpendicular to the telescoping handle assembly.

22. The wheeled carrier of claim 21, wherein the attachment portion, when engaged laterally between the two legs, is rotatable about an axis perpendicular to the plane.

23. The wheeled carrier of claim 21, wherein the channel has two curved sections opposite one another.

24. The wheeled carrier of claim 21, wherein the platform shelf includes a carrying handle.

* * * * *